US008526858B2

(12) United States Patent
Tamaki

(10) Patent No.: US 8,526,858 B2
(45) Date of Patent: Sep. 3, 2013

(54) IMAGE FORMING APPARATUS HAVING COLOR AND TRANSPARENT DEVELOPING DEVICES

(75) Inventor: Masayuki Tamaki, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 14 days.

(21) Appl. No.: 13/409,633

(22) Filed: Mar. 1, 2012

(65) Prior Publication Data

US 2012/0163870 A1 Jun. 28, 2012

Related U.S. Application Data

(63) Continuation of application No. PCT/JP2010/066109, filed on Sep. 10, 2010.

(30) Foreign Application Priority Data

Sep. 10, 2009 (JP) ..... 2009-209343

(51) Int. Cl.
*G03G 15/01* (2006.01)

(52) U.S. Cl.
USPC ..... 399/223

(58) Field of Classification Search
USPC ..... 399/39, 54, 223, 228
See application file for complete search history.

(56) References Cited

U.S. PATENT DOCUMENTS

| | | | | |
|---|---|---|---|---|
| 7,260,347 | B2 | 8/2007 | Tamaki et al. | |
| 7,349,653 | B2 | 3/2008 | Nishihama et al. | |
| 7,349,655 | B2 | 3/2008 | Fukuda et al. | |
| 7,430,389 | B2 * | 9/2008 | Noguchi et al. | 399/223 |
| 7,558,516 | B2 | 7/2009 | Fukuda et al. | |
| 7,773,915 | B2 | 8/2010 | Akita | |
| 7,890,026 | B2 | 2/2011 | Naruge | |
| 7,941,078 | B2 * | 5/2011 | Bae et al. | 399/231 |
| 7,991,328 | B2 * | 8/2011 | Masui | 399/223 |
| 2006/0198661 | A1 | 9/2006 | Nishihama et al. | |
| 2006/0198662 | A1 | 9/2006 | Fukuda et al. | |
| 2007/0172260 | A1 | 7/2007 | Fukuda et al. | |
| 2008/0063421 | A1 | 3/2008 | Tamaki | |
| 2008/0152390 | A1 | 6/2008 | Akita | |
| 2009/0016775 | A1 | 1/2009 | Naruge | |

FOREIGN PATENT DOCUMENTS

| | | | |
|---|---|---|---|
| JP | 2-21591 | B | 5/1990 |
| JP | 7-266614 | A | 10/1995 |
| JP | 11-194617 | A | 7/1999 |
| JP | 2003-5518 | A | 1/2003 |
| JP | 2003-177602 | A | 6/2003 |
| JP | 2005-24799 | A | 1/2005 |
| JP | 200671729 | A | 3/2006 |
| JP | 2006-250959 | A | 9/2006 |
| JP | 2006-250960 | A | 9/2006 |

(Continued)

OTHER PUBLICATIONS

International Search Report mailed Nov. 2, 2010, in PCT/JP2010/066109.

*Primary Examiner* — Robert Beatty
(74) *Attorney, Agent, or Firm* — Fitzpatrick, Cella, Harper & Scinto

(57) ABSTRACT

In an image forming apparatus having a color developing device and a transparent developing device the triboelectric chargeability of the transparent toner by a developer carrying member provided in the transparent developing device is made higher than a triboelectric chargeability of a color toner by a developer carrying member provided in the color developing device.

12 Claims, 19 Drawing Sheets

(56) References Cited

FOREIGN PATENT DOCUMENTS

| | | | |
|---|---|---|---|
| JP | 2006-301495 | A | 11/2006 |
| JP | 2007-199209 | A | 8/2007 |
| JP | 2008-65123 | A | 3/2008 |
| JP | 2008-176316 | A | 7/2008 |
| JP | 2009-20434 | A | 1/2009 |

* cited by examiner (a)

(b)

(a) FOR TRANSPARENT TONER (b) FOR COLOR TONER

IMAGE FORMING APPARATUS HAVING COLOR AND TRANSPARENT DEVELOPING DEVICES

This application is a continuation of International Patent Application No. PCT/JP2010/066109, filed Sep. 10, 2010.

TECHNICAL FIELD

The present invention relates to an image forming apparatus for forming an image by using a color toner and a transparent toner.

BACKGROUND ART

In recent years, in an image forming apparatus of an electrophotographic type, the image forming apparatus for outputting the image by using the color toner and the transparent toner has been put into practical use. The transparent toner is a toner in which a colorant (pigment) is not contained, and cam adjusts glossiness without changing a color tint when being fixed on a recording material. Therefore, a constitution of the image forming apparatus in which the transparent toner is formed at a portion where the color toner is not formed to uniformize the glossiness of the whole image fixed on the recording material is disclosed in the following document.

In Japanese Laid-Open Patent Application (JP-A) 2008-65123, the image forming apparatus in which an image forming portion for clear (transparent) is disposed at a downstream side of image forming portions for yellow, magenta, cyan and black which are disposed along an intermediary transfer belt is shown. In the image forming apparatus described in JP-A 2008-65123, the four color developing devices using color toner developers and the transparent developing device using a transparent toner developer has just the same constitution.

Also in the image forming apparatus shown in JP-A 2008-176316, the four color developing devices and the transparent developing device which are disposed along the intermediary transfer belt are equally constituted. However, between the color developing devices and the transparent developing device, rotational directions of developer carrying members rotating around fixed magnets are set at opposite directions.

Also in the image forming apparatus shown in JP-A 2007-199209, four color developing devices using color toner two-component developers and a transparent developing device using a transparent toner two-component developer is disclosed. Further, constitutions of the color developing devices and a constitution of the transparent developing device are equal to each other.

Here, in the case where a glossiness of the image is intended to be uniform by using the transparent toner, an amount of use of the color toners. When the toner in the developing device is consumed by development, an uncharged (or small charge amount) toner is supplied into the developing device so as to compensate for a consumption amount (component).

That is, compared with the color toner, the amount of the transparent toner supplied into the developing device which accommodates the transparent toner becomes large. When the amount of the toner supplied into the developing device becomes large, the amount of the toner, fed to the neighborhood of a developing sleeve as a developer carrying member, which has a small charge amount per unit weight (or which is unchanged) without being sufficiently stirred (charged) becomes large.

Such a problem that the toner with the small charge amount is carried on the developing sleeve as the developer carrying member and is deposited on a non-image portion when it reaches a developing region where the electrostatic image carried on the photosensitive member is developed occurs. There was also a problem such that the toner with the small charge amount is scattered without being subjected to the development of the electrostatic image.

Therefore, an object of the present invention is to bring the charge amount per unit weight of the transparent toner close to the charge amount per unit weight of the color toner. Specifically, the object is to suppress scattering of the transparent toner caused by an increase in amount of use of the transparent toner compared with the color toner and by conveyance of the toner, with a charge amount smaller than a desired charge amount, to the neighborhood of the developing sleeve.

DISCLOSURE OF THE INVENTION

Therefore, the image forming apparatus according to the present invention is an image forming apparatus comprising: a color developing device for developing with a color toner an electrostatic image formed on a photosensitive member, the color developing device including a fixed magnet provided with a plurality of poles, a developer carrying member which is rotated around the fixed magnet and carries a color developer comprising a color toner and a carrier, and a layer thickness regulating member which is provided opposed to the developer carrying member and regulates a layer thickness of the carried color developer; and a transparent developing device for developing with a transparent toner an electrostatic image formed on a photosensitive member, the transparent developing device including a fixed magnet provided with a plurality of poles, a developer carrying member which is rotated around the fixed magnet and carries a transparent developer comprising a transparent toner and a carrier, and a layer thickness regulating member which is provided opposed to the developer carrying member and regulates a layer thickness of the carried transparent developer, wherein a distance from a downstream one of adjacent magnetic poles of the same polarity of the fixed magnet of the transparent developing device with respect to a developer carrying member rotational direction to a position opposing the layer thickness regulating member is longer than a distance from a downstream one of adjacent magnetic poles of the same polarity of the fixed magnet of said color developing device with respect to the developer carrying member rotational direction to the position opposing the layer thickness regulating member.

Further, the present invention is characterized in that a magnetic confining force of the magnetic pole, of the magnetic poles of the fixed magnet of the transparent developing device, located immediately upstream of the regulating member along the developer carrying member rotational direction is stronger than a magnetic confining force of the magnetic pole, of the magnetic poles of the fixed magnet of the color developing device, located immediately upstream of the regulating member along the developer carrying member rotational direction.

Figure 3:
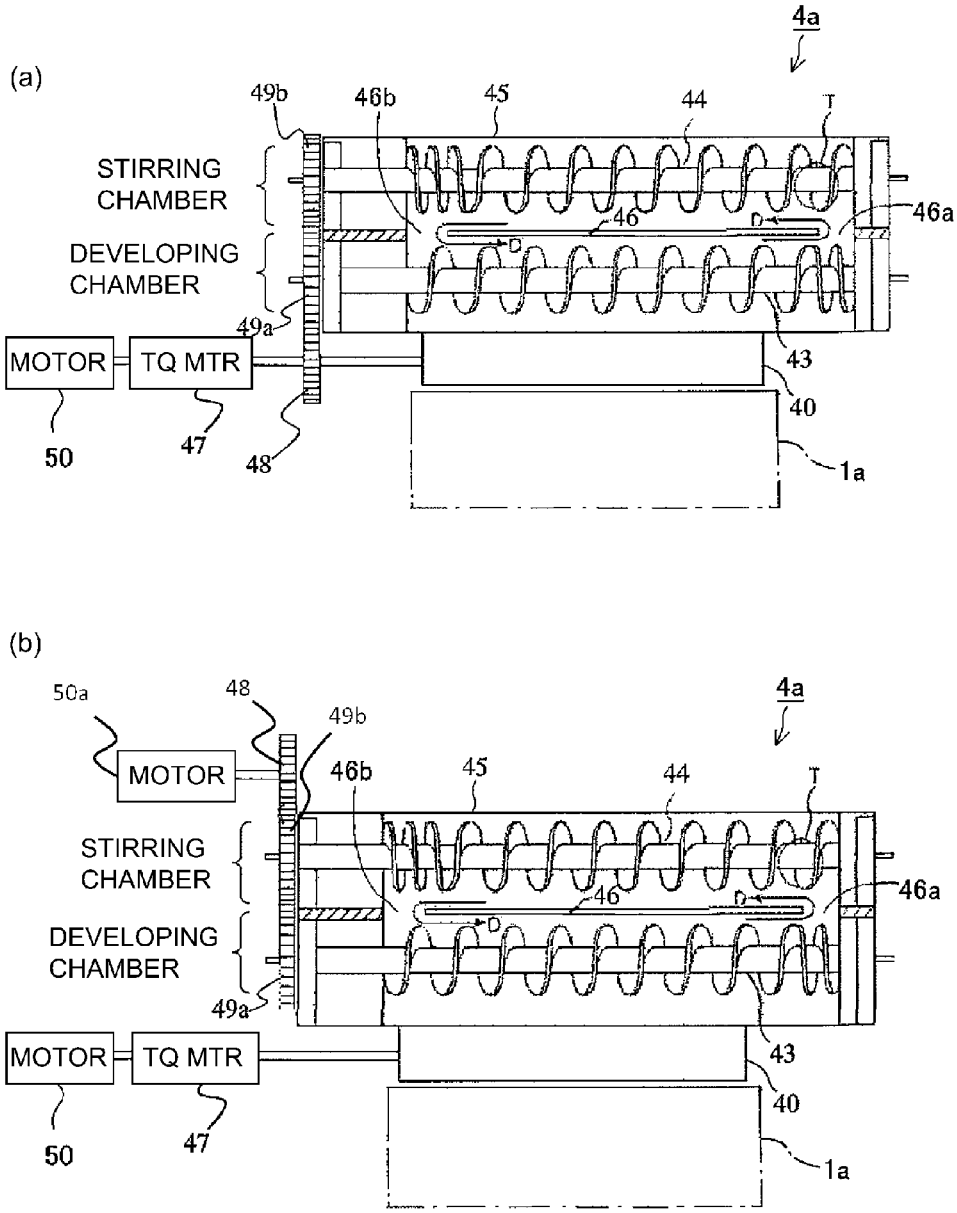

Parts (a) and (b) of FIG. 3 are illustrations of a planar structure of a developing device and a driving torque detecting method.

Figure 4:
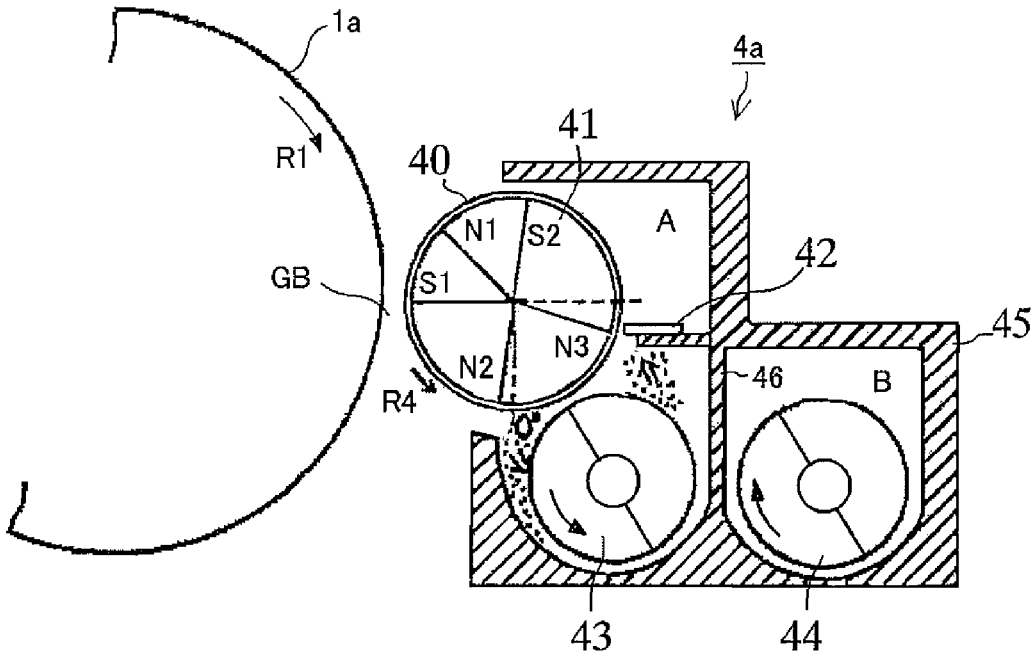

FIG. 4 is an illustration of a vertical cross-sectional structure of a color developing device.

Figure 5:
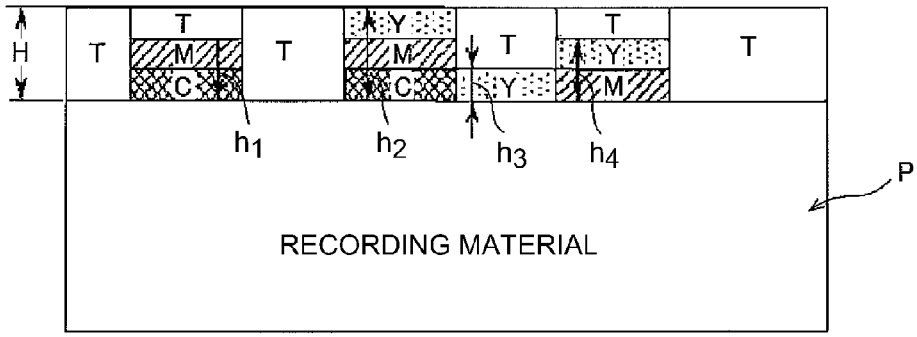
Figure 5:
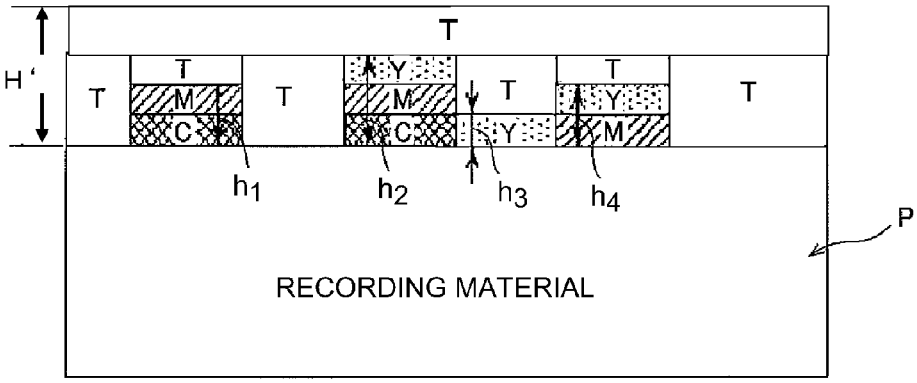

Parts (a) and (b) of FIG. 5 are illustrations of image flattening using a transparent image.

Figure 6:
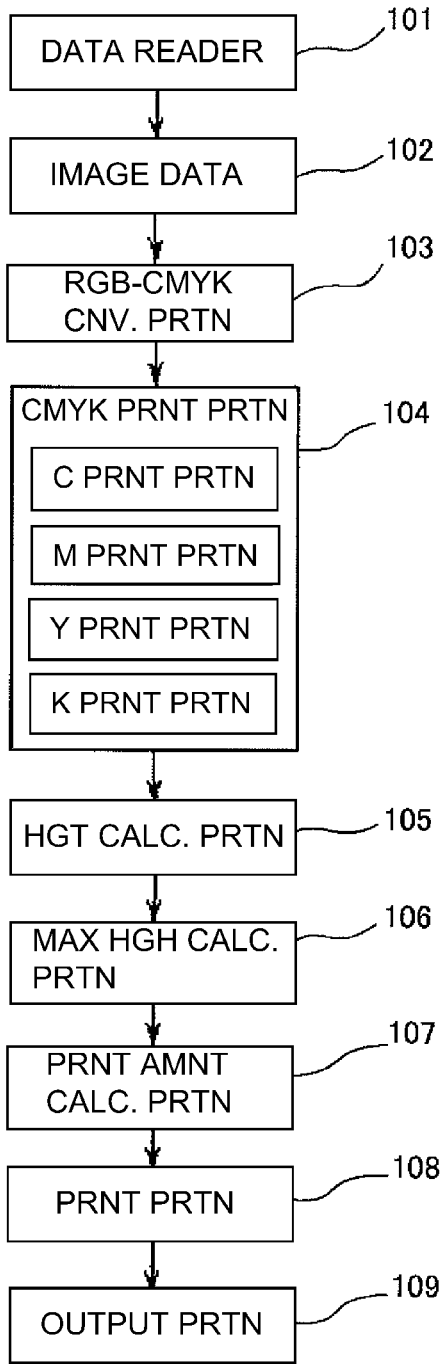

FIG. 6 is a flow chart of the flattening.

Figure 7:
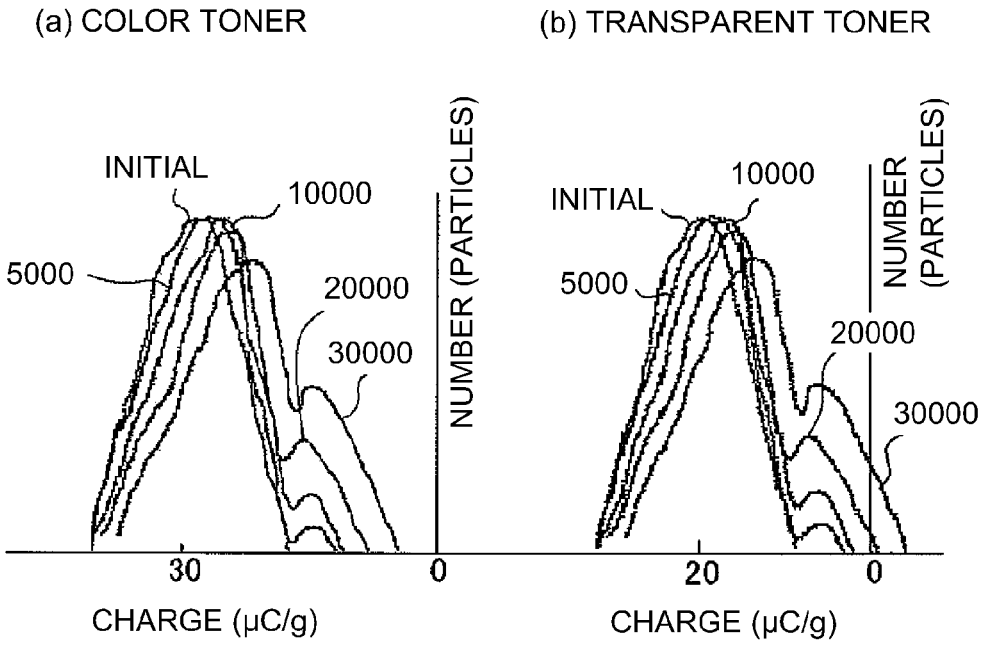

Parts (a) and (b) of FIG. 7 are illustrations of progressions of charge amounts of a color toner and a transparent toner, respectively.

Figure 8:
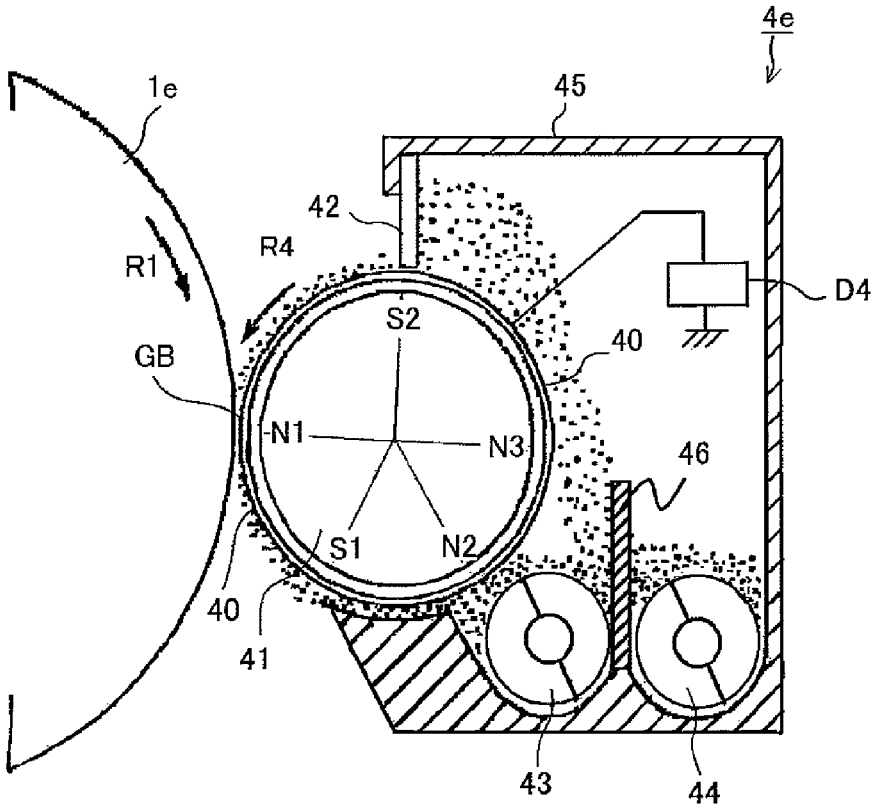

FIG. 8 is an illustration of a vertical cross-sectional structure of a transparent developing device in Embodiment 1.

Figure 9:
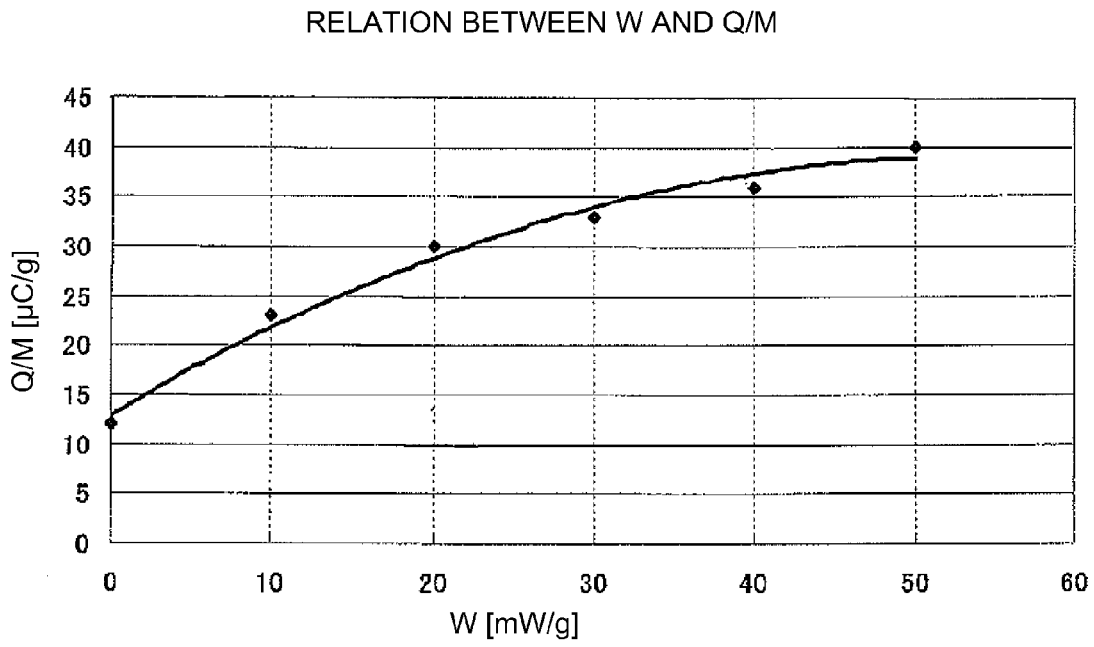

FIG. 9 is an illustration of a relationship between a (degree of) condensation and a toner charge amount.

Figure 10:
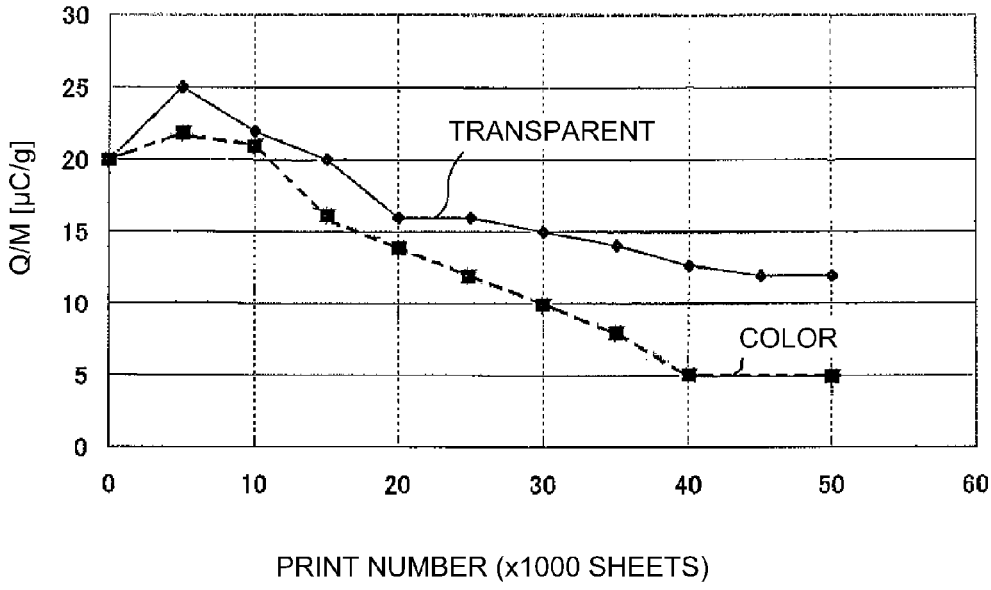

FIG. 10 is an illustration of progressions of toner charge amounts compared based on a difference in developing device.

Figure 11:
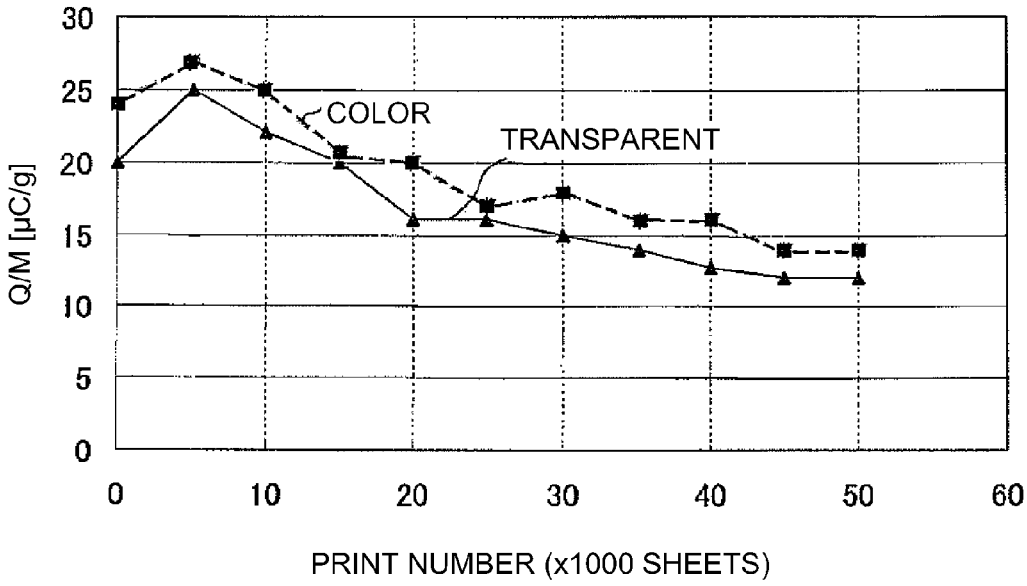

FIG. 11 is an illustration of a durability experiment in which the image flattening is effected by developing devices in Embodiment 1.

Figure 12:
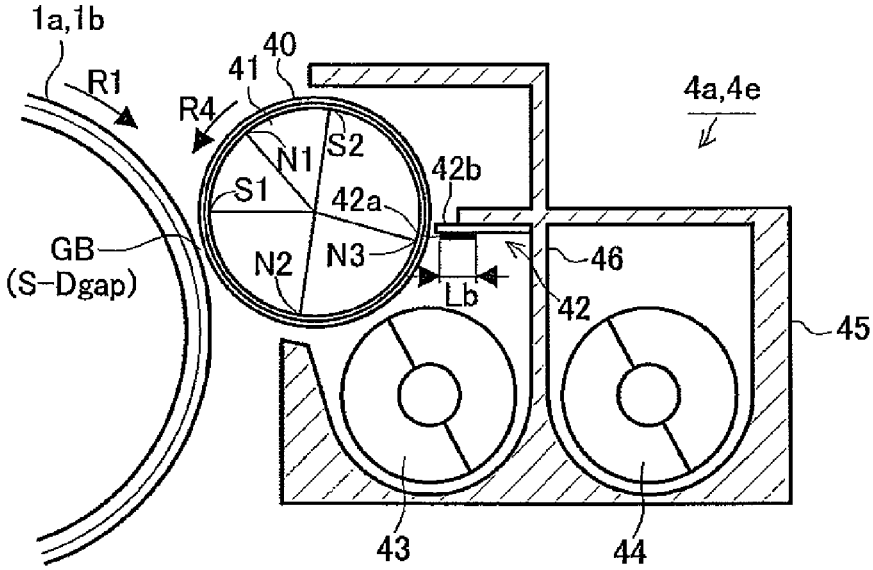

FIG. 12 is an illustration of a structure of a layer thickness regulating member in a developing device in Embodiment 3.

Figure 13:
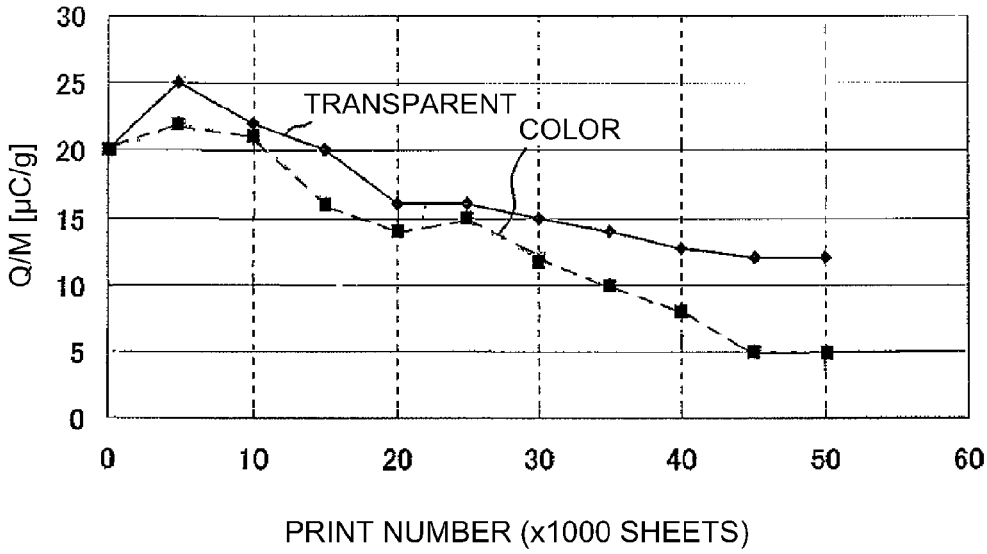

FIG. 13 is an illustration of progressions of charge amounts Q/M of toners in Embodiment 3.

Figure 14:
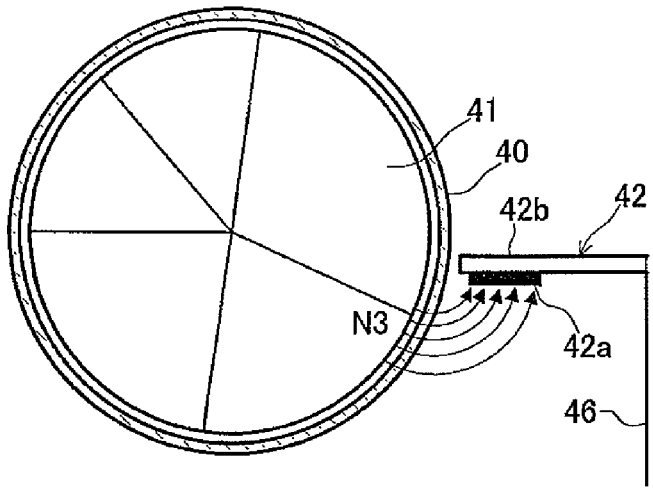
Figure 14:
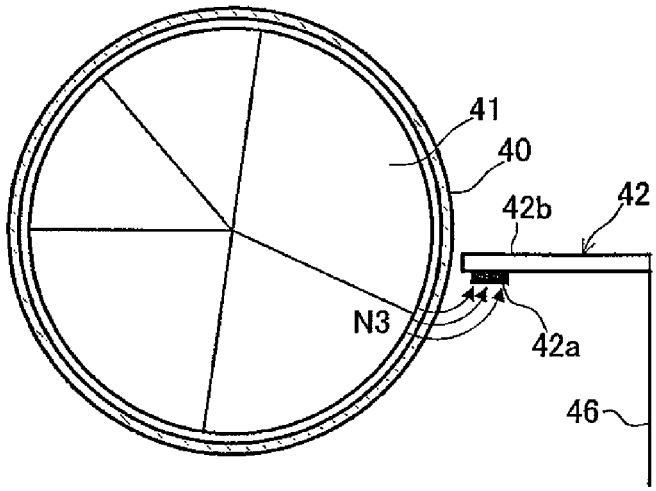

Parts (a) and (b) of FIG. 14 are illustrations of relationships each between a length of a non-magnetic developing blade and an amount of magnetic flux.

Figure 15:
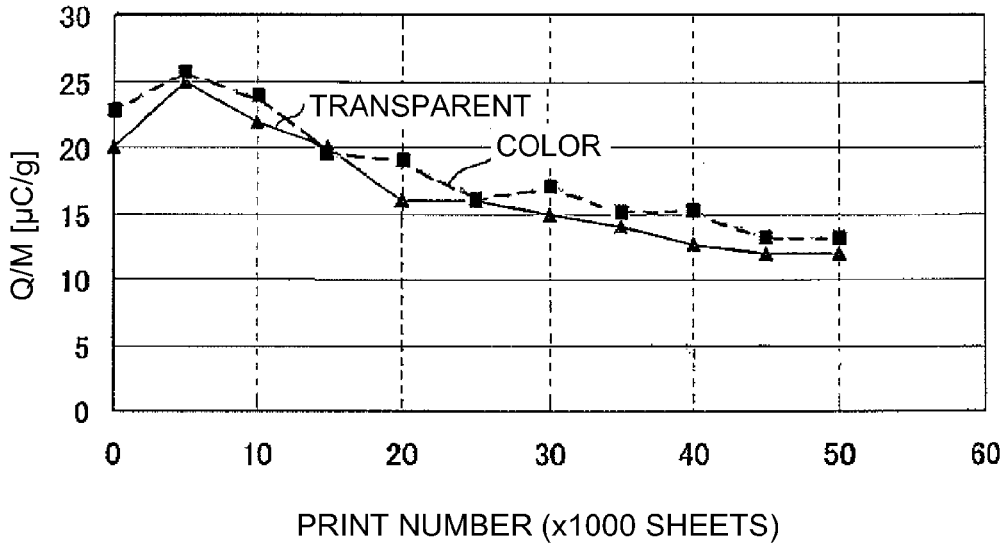

FIG. 15 is an illustration of a durability experiment in which the image flattening is effected by developing devices in Embodiment 3.

Figure 16:
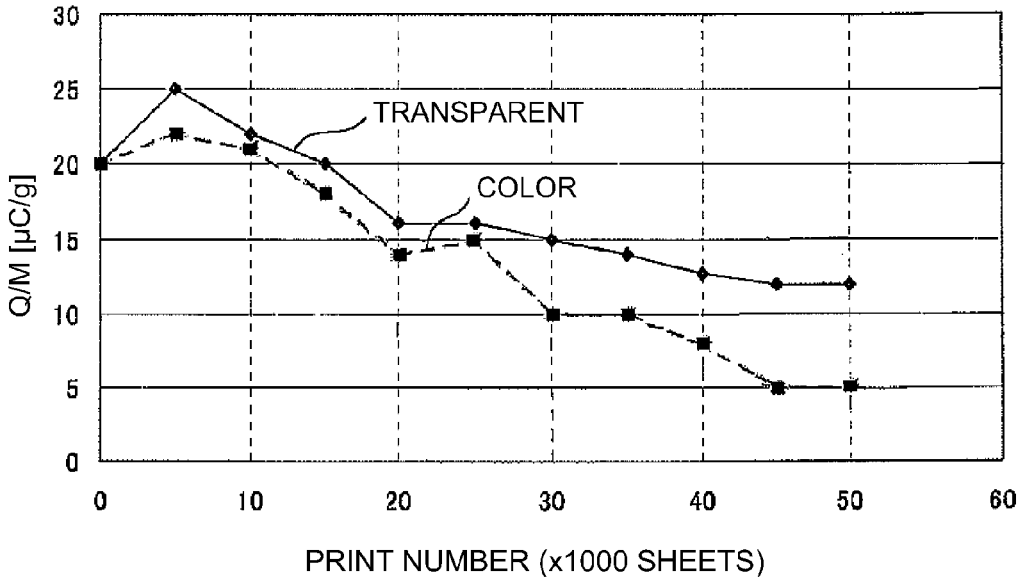

FIG. 16 is an illustration of progressions of charge amounts Q/M of toners in Embodiment 4.

Figure 17:
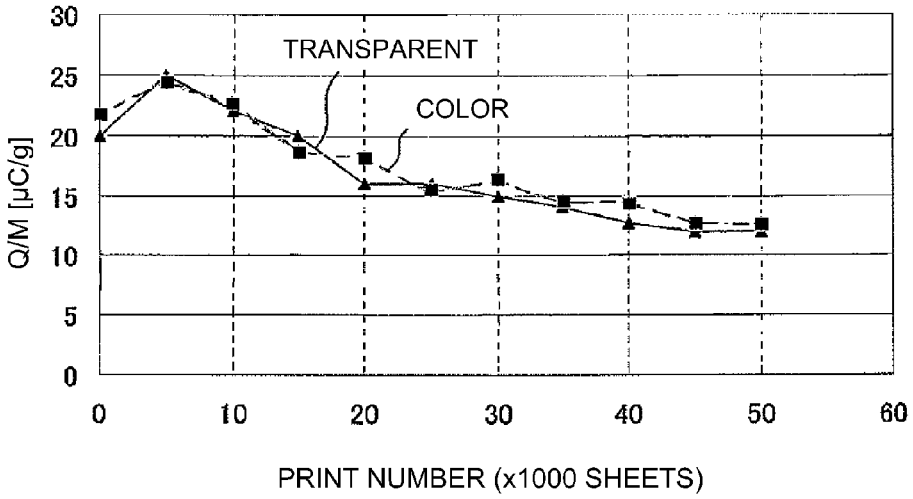

FIG. 17 is an illustration of a durability experiment in which the image flattening is effected by developing devices in Embodiment 4.

Figure 18:
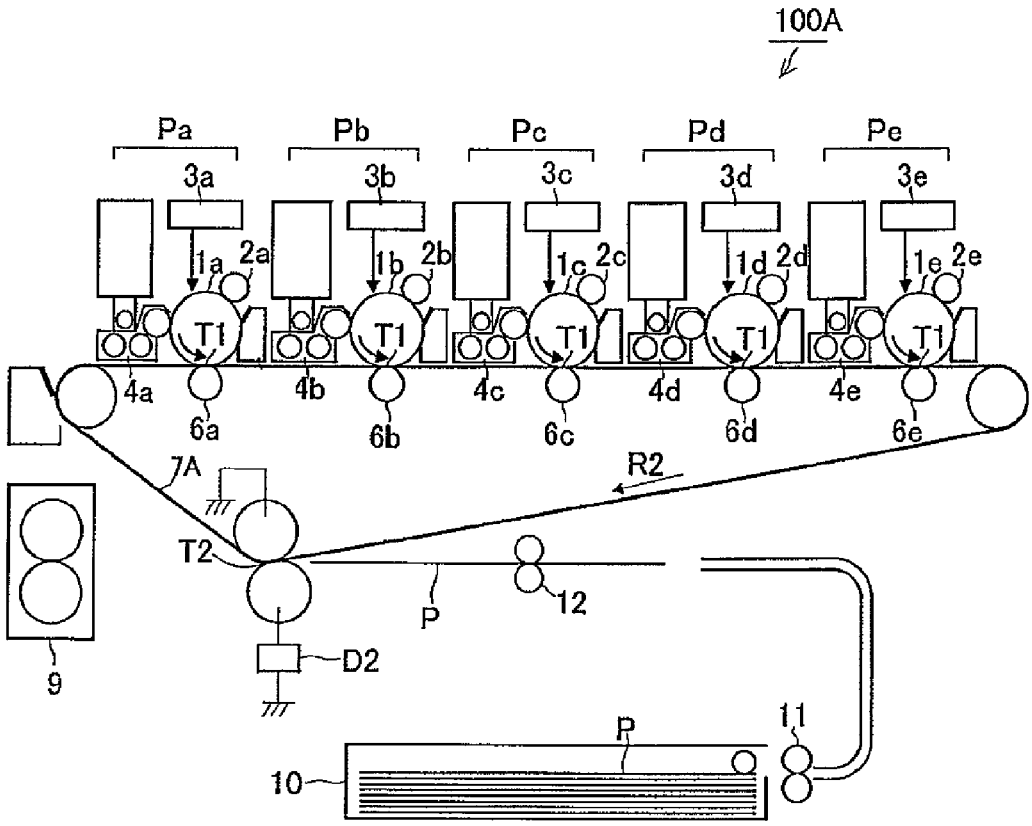

FIG. 18 is an illustration of a structure of an image forming apparatus in Embodiment 5.

Figure 19:
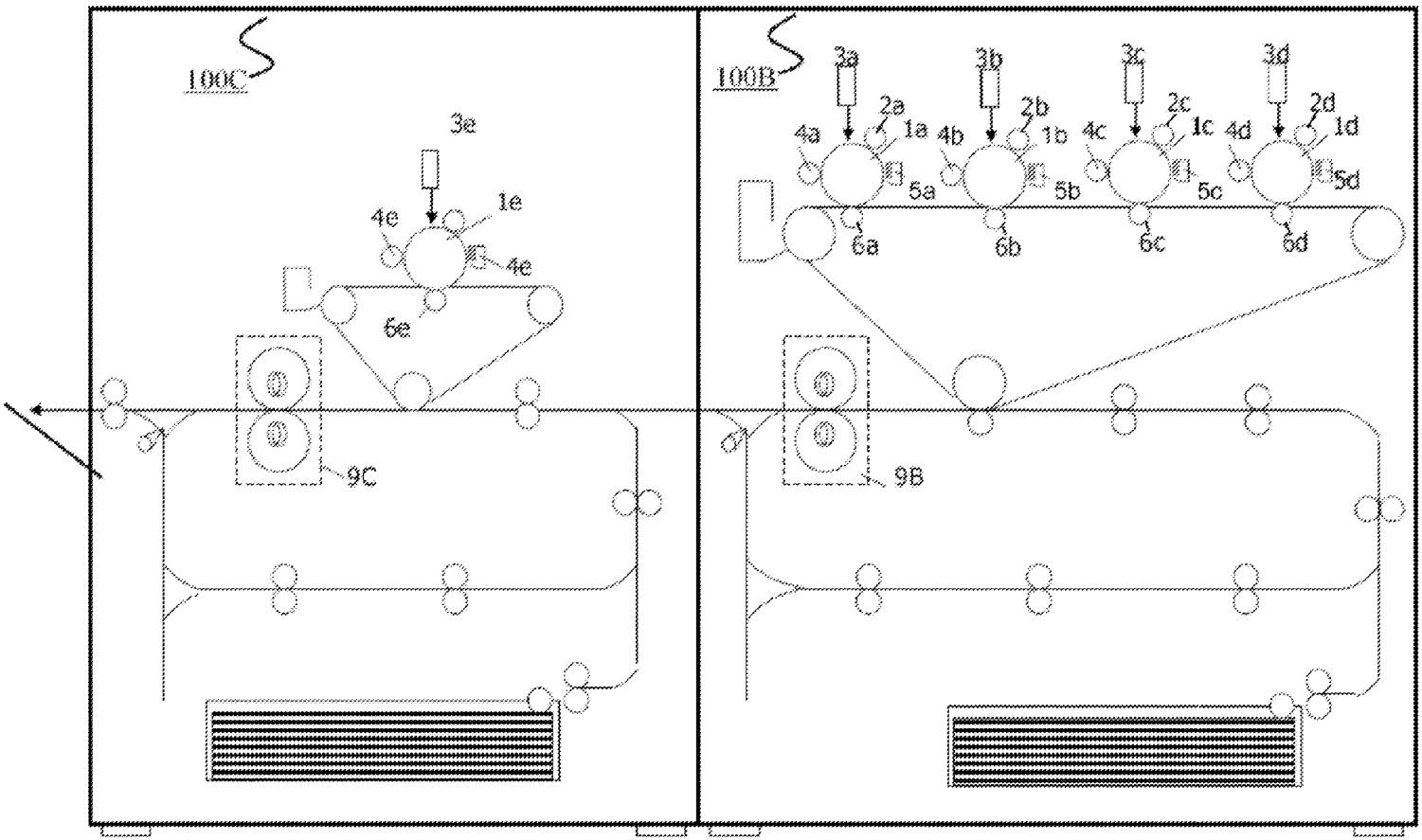

FIG. 19 is an illustration of a structure of an image forming apparatus in Embodiment 6.

BEST MODE FOR CARRYING OUT THE INVENTION

Hereinbelow, embodiments of the present invention will be described with reference to the drawings. The present invention can also be carried out in other embodiments in which a part or all of constitutions of the following embodiments are replaced with alternative constitutions so long as a driving load of a developer carrying member of a transparent developing device (colorless developing device) is higher than that of a color developing device.

Therefore, the present invention can be carried out irrespective of tandem type/one-drum type and intermediary transfer type/direct transfer type. In the following embodiments, only a major part of the image forming apparatus relating to formation and transfer of the toner image will be described but the present invention can be carried out in various fields of apparatuses or machines such as printers various printing machines, copying machines, facsimile machines, and multi-function machines.

Incidentally, general matters of the image forming apparatuses described in JP-A 2008-65123, JP-A 2008-176316 and JP-A 2007-199209 will be omitted from illustration and redundant explanation.

<Image Forming Apparatus>

Figure 1:
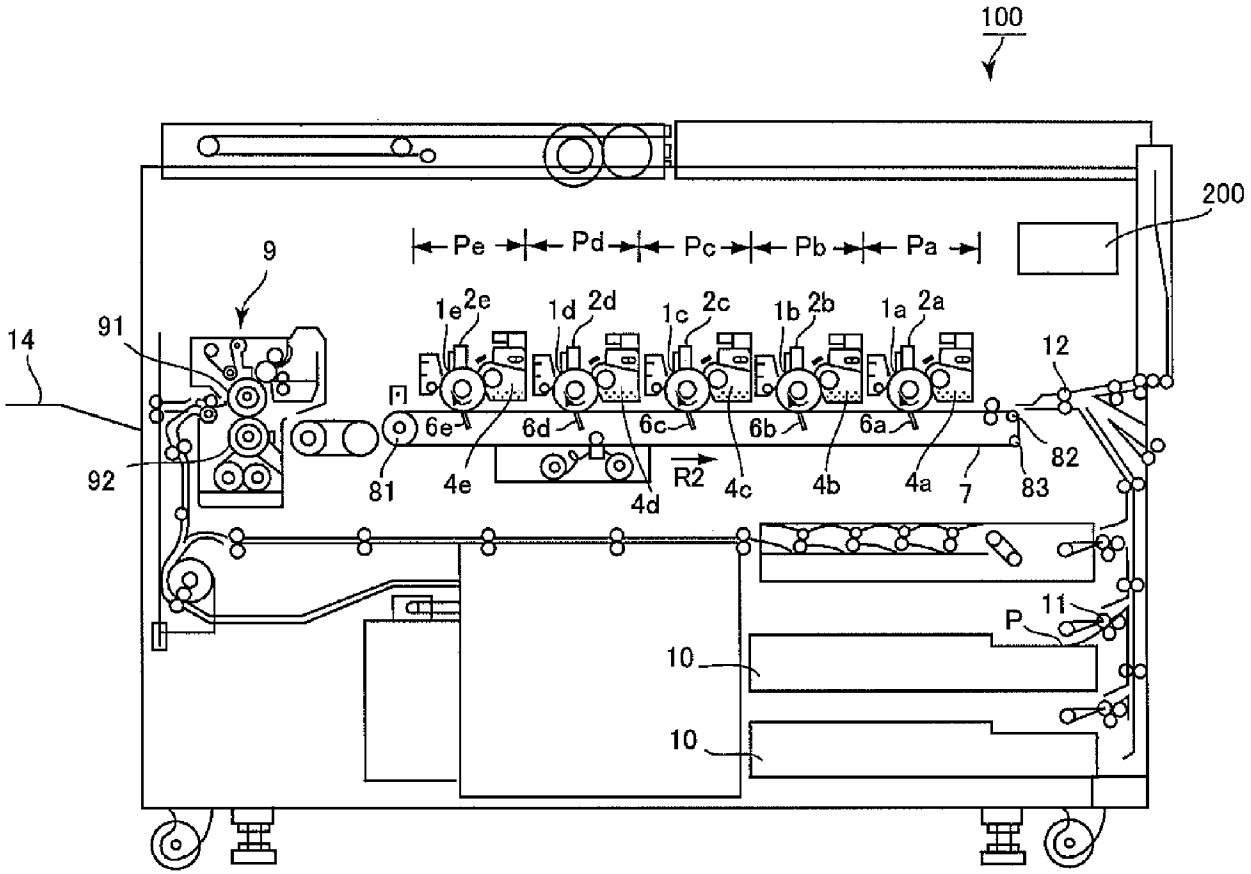
FIG. 1 is an illustration of a structure of an image forming apparatus.
Figure 2:
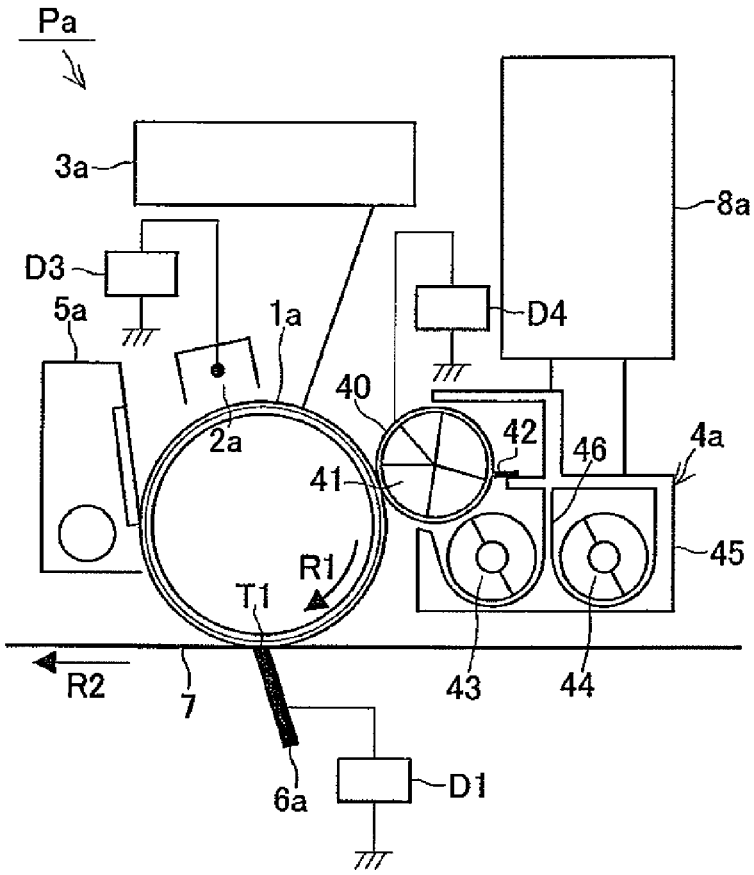
FIG. 2 is an illustration of a structure of an image forming portion.

FIG. 1 is an illustration of a structure of an image forming apparatus. FIG. 2 is an illustration of a structure of an image forming portion. As shown in FIG. 1, the image forming apparatus 100 is a direct transfer type full-color printer of the tandem type in which image forming portions Pa for yellow, Pb for magenta, Pc for cyan, Pd for black and Pe for clear are disposed along a recording material conveyance belt 7.

At the image forming portion Pa, a yellow toner image is formed on a photosensitive drum 1*a* and then is transferred onto a recording material carried on the recording material conveyance belt 7. At the image forming portion Pb, a magenta toner image is formed on a photosensitive drum 1*b* and then is transferred superposedly onto the yellow toner image on the recording material P. At the image forming portions Pc and Pd, a cyan toner image and a black toner image are formed on a photosensitive drum 1*c* and a photosensitive drum 1*d*, respectively, and are similarly transferred superposedly onto the recording material P. At the image forming portion Pe, a transparent image can be outputted superposedly on the color images on the recording material. An electrostatic image formed on a photosensitive drum 1*e* is developed by a developing device 4*e*, and a transparent toner image can be outputted.

The recording material P on which the toner images of five colors in total are transferred is curvature-separated from the recording material conveyance belt 7 at a curved surface of a separation roller 81 and is subjected to heating and pressing by a fixing device 9 to fix the toner images on its surface and thereafter is discharged onto a discharge tray 14 outside the apparatus.

The recording material conveyance belt 7 is supported by being extended around the separation roller 81, a stretching roller 82 and a tension roller 83 and is driven by the separation roller 81 also functioning as a driving roller, thus being rotated at a predetermined process speed in an arrow R1 direction.

The recording material P pulled out from a recording material cassette 10 is separated one by one by a separating roller 11 to be sent to a registration roller 12. The registration roller 12 receives the recording material P in a rest state to place the recording material P in a stand-by condition and then the recording material P is carried on the recording material conveyance belt 7 while being timed to the toner image formation at the image forming portion Pa. The recording material conveyance belt 7 sends the recording material P to a contact portion between the photosensitive drum 1*a* and the recording material conveyance belt 7.

The image forming portions Pa, Pb, Pc, Pd and Pe are constituted substantially identically except that a structure for carrying the developer in a thin layer on the developer carrying member between developing devices 4*a*, 4*b*, 4*c* and 4*d* and the developing device 4*e*. In the following, the image forming portion Pa will be described and with respect to the image forming portions Pb, Pc, Pd and Pe, the suffix a of reference numerals (symbols) for representing constituent members for the image forming portion Pa is to be read as b, c, d and e, respectively, for explanation.

As shown in FIG. 2, the image forming portion Pa includes a corona charger 2*a*, an exposure device 3*a*, the developing device 4*a*, a transfer blade 6*a* and a cleaning device 5*a* which are disposed at a peripheral of the photosensitive drum 1*a*.

The photosensitive drum 1*a* is prepared by forming a photosensitive layer having a negative charge polarity on an outer peripheral surface of an aluminum cylinder and is rotated at a predetermined process speed in an arrow R1 direction. The corona charger 2*a* irradiates the photosensitive drum 1*a* with charged particles generated with corona discharge, thus charging the surface of the photosensitive drum 1*a* to a uniform negative dark-portion potential VD. The exposure device 3*a* effects scanning, by a rotating mirror, of a laser beam subjected to ON-OFF modulation of a scanning line image data obtained by developing a separated color image of yellow, thus writing an electrostatic image for an image on the surface of the charged photosensitive drum 1*a*.

In the developing device 4*a*, a two-component developer in which a yellow non-magnetic toner and a magnetic carrier are mixed is filled in a predetermined amount. In a supplying device 8*a*, the yellow non-magnetic toner is filled and the supplying device 8*a* supplies the toner, in an amount corresponding to that used for image formation, to the developing device 4*a*, so that a toner content or concentration (T/D ratio) is kept in a predetermined range. The toner content is a weight ratio of the toner to the two-component developer. The developing device 4*a* charges the two-component developer and carries the two-component developer on a developing sleeve 40 and then transfers the toner onto the electrostatic image on the photosensitive drum 1*a*, thus developing the electrostatic image into the toner image as described later.

The transfer blade 6*a* urges an inner surface of the recording material conveyance belt 7 to form a transfer portion T1 between the photosensitive drum 1*a* and the recording material conveyance belt 7. A power source D1 applies a positive DC voltage to the transfer blade 6*a*, whereby the negative toner image carried on the photosensitive drum 1*a* is transferred onto the recording material P which is carried on the recording material conveyance belt 7 and passes through the transfer portion T1.

The cleaning device 5*a* rubs the photosensitive drum 1*a* with a cleaning blade, thus collecting a transfer residual toner which escapes the transfer onto the recording material P and remains on the photosensitive drum 1*a*.

<Two-Component Developer>

The two-component developer contains the magnetic carrier and the non-magnetic toner, and the non-magnetic toner contains inorganic fine particles as an external additive. The average particle size of the magnetic carrier is 50 μm, the average particle size of the non-magnetic toner is 6 μm, and the average particle size of the inorganic fine particles is 4-80 nm. The toner content (T/D ratio) which is a weight ratio of the non-magnetic toner to the two-component developer is 3.0-12.0%, preferably 4.0-11.0%. When the toner content is less than 3.0%, an image density is lowered and in addition, a deterioration of the magnetic carrier is accelerated and thus a lifetime of the two-component developer is shortened. On the other hand, also when the toner content exceeds 12.0%, the lifetime of the two-component developer is shortened as a result, and further there arises a problem that degrees of a fog image and scattering in the apparatus are increased.

An addition amount of the inorganic fine particles may preferably be 0.1-3.0% as the weight ratio of the inorganic fine particles to the non-magnetic particles. When the addition amount is less than 0.1%, an effect of the addition is not sufficient, and when the addition amount exceeds 3.0%, an amount of liberation of the inorganic fine particles becomes large, so that a variation of the charge amount of the non-magnetic toner becomes large. As a result, toner scattering into the apparatus is liable to occur. As the inorganic fine particles, silica fine particles were used. As the silica fine particles, dry-process silica which is so-called dry-type silica or fumed silica formed by vapor-phase oxidation of silicon halide was used. The dry-process silica contains a silanol group in a small amount at the surface of and inside the silica fine particles and contains a manufacturing residue such as $Na_2O$ or $SO_3$ in a small amount and therefore can be utilized more than a so-called wet-process silica manufactured from water glass or the like.

Even in a high-humidity environment, the inorganic fine particles are hydrophobized in order to keep the charge amount of the toner particles at a high level and to prevent the toner scattering. The hydrophobization of the inorganic particles used, as a first-stage reaction, a process in which silitation reaction was effected to cause the silanol group to disappear by chemical bond. By silicone oil, a hydrophobic thin film may also be formed at the surface. The average particle size of the inorganic fine particles was obtained as a number-average particle size by measuring the particle size of 100 or more inorganic fine particles extracted from those present at the non-magnetic toner surface through a photographic image of the ion-magnetic toner obtained by photomacrography with a scanning electron microscope.

<Color Developing Device>

Part (a) and (b) of FIG. 3 are illustrations of a planar structure of the developing device. FIG. 4 is an illustration of a vertical cross-sectional structure of the color developing device.

As shown in (a) and (b) of FIG. 3, inside a developing container 45 of the developing device 4*a*, a stirring screw 44 is disposed in a second chamber B with a partition wall 46 (interposed between a first chamber A and the second chamber B), and a feeding screw 43 is disposed in the first chamber A. The stirring screw 44 and the feeding screw 43 feed the two-component developer in parallel and opposite directions in the first chamber A and the second chamber B<respectively, while stirring the two-component developer, thus circulating the two-component developer in the developing container 45. During the circulation of the two-component developer under stirring, the non-magnetic toner and the magnetic carrier in the two-component developer are subjected to friction, so that the non-magnetic toner is charged to the negative polarity and the magnetic carrier is charged to the positive polarity.

As shown in FIG. 4, the feeding screw 43 feeds the charged two-component developer to the developing sleeve 40 which is an example of the developer carrying member. The charged two-component developer is carried on the developing sleeve 40 in a chain-erected state to slide on the photosensitive drum 1*a*. A power source D4 applies an oscillating voltage, in the form of a DC voltage biased with an AC voltage, to the developing sleeve 40, so that the negatively charged toner is transferred onto an exposed portion of the photosensitive drum 1*a* which is positive relative to the developing sleeve 40 and thus the electrostatic image is reversely developed.

The developing sleeve 40 is prepared in a thin pile of a non-magnetic material such as aluminum or stainless steel and is rotatably provided opposed to the photosensitive drum 1*a* rotating in the arrow R1 direction. The developing sleeve 40 rotates in an arrow R4 direction so that its surface moves in the same direction as that of the surface of the photosensitive drum 1*a* at an opposing portion to the photosensitive drum 1*a*. For this reason, the opposing portion (developing portion) GB between the developing sleeve 40 and the photosensitive drum 1*a* is located between a vertical lowermost point of the developing sleeve 40 to 180-degree upstream point with respect to the rotational direction of the developing sleeve 40.

Inside the developing sleeve 40, a magnet roller 41 as a fixed magnet having 5 magnetic poles is provided non-rotatably. The 5 magnetic poles are respective magnetic poles from a main developing pole S1 disposed opposed to the photosensitive drum 1*a*, in the order of a peeling (removing)

pole N2, a carrying pole N3, and retaining poles S2 and N1 as seen in the rotational direction of the developing sleeve 40.

The layer thickness regulating member 42 is a blade member molded in a 1.5 mm-thick plate-like shape only of a magnetic material. The layer thickness regulating member 42 is disposed downstream of the carrying pole N3 by 5 degrees with respect to the rotational direction of the developing sleeve 40 so that it opposes the developing sleeve 40 with a spacing of 640 μm.

An opposing gap (S-D gap) between the developing sleeve 40 and the photosensitive drum 1*a* is convenient, when the gap is 150-800 μm, with respect to prevention of deposition of the magnetic carrier on the drum and improvement of dot reproducibility. When the opposing gap is excessively narrow, supply of the two-component developer to the electrostatic image becomes insufficient and thus the image density is liable to become low. When the opposing gap is excessively wide, magnetic lines of force of the main developing pole S1 diverge and thus an erected chain density is lowered, so that the dot reproducibility is lowered and a magnetic carrier confining force becomes insufficient and thus the deposition of the magnetic carrier on the drum is liable to occur.

The AC voltage of the oscillating voltage may preferably include a peak-to-peak voltage of 300-2000 Vpp. When the peak-to-peak voltage of the AC voltage is lower than 300 V, a sufficient image density is not readily obtained in some cases. In the case where the peak-to-peak voltage exceeds 2000 V, the electrostatic image is disturbed via the erected chain (magnetic brush), so that a lowering in image quality is caused in some cases.

A frequency of the AC voltage may preferably be 500-20000 Hz. When the frequency is lower than 500 Hz, when the toner contacting the photosensitive drum 1*a* is returned to the developing sleeve 40, sufficient vibration cannot be imparted to the toner and thus fog is liable to occur although its degree varies depending on the process speed. When the frequency exceeds 20000 Hz, the toner cannot follow the electric field, so that the lowering in image quality is liable to be caused. As a waveform and pattern of the AC voltage, it is possible to exemplify a blank pulse, a triangular wave, a rectangular wave, a sinusoidal wave or a waveform changed in duty ratio.

In the case where the reverse development is effected, a potential difference between the dark-portion potential VD at a non-exposed portion of the photosensitive drum 1*a* and a DC voltage Vdc applied to the developing sleeve 40 becomes a fog-removing voltage Vback. A potential difference between a light-portion potential VL at the exposed portion of the photosensitive drum 1*a* and the DC voltage Vdc applied to the developing sleeve 40 becomes a developing contrast Vcont. The fog-removing voltage Vback may preferably be 200 V or less, preferably 150 V or less although it varies depending on the structure and control of the developing device 4*a*. As the developing contrast Vcont, 100-400 V is used so that a sufficient image density can be ensured. In order to stabilize a half-tone gradation property of the image, the developing contrast may preferably be as high as possible and may preferably be 150 V or more.

By using the two-component developer containing the satisfactorily charged toner, the fog-removing voltage Vback can be lowered, and the dark-portion VD can be made at a low level by lowering the DC voltage used for the charging of the photosensitive drum 1*a*. By lowering the DC voltage used for the charging, the lifetime of the photosensitive drum 1*a* is prolonged.

The two-component developer in the first chamber A is fed from a rear side to a front side in a direction perpendicular to the drawing sheet surface while being stirred by the feeding screw 43. At this time, a part of the fed two-component developer is scooped up by being magnetically attracted to the carrying pole N3 of the magnet roller 41.

In the developing device 4*a* which is the color developing device, a maximum magnetic flux density at the surface of the developing sleeve 40 at the position of the carrying pole N3 is 620 gausses, and a half-width of the magnetic flux density is 35 degrees. The two-component developer scooped up by being magnetically attracted to the carrying pole N3 is regulated in a layer thickness of about 35 mg/cm$^2$ by the magnetic field between the layer thickness regulating member 42 and the carrying pole N3.

The two-component developer which layer thickness is regulated by the layer thickness regulating member 42 is successively fed to positions of the retaining poles S2 and N1, and erection and flattening are repeated in response to the direction of the magnetic field, so that the two-component developer is erected at the main developing pole S1 to form a magnetic chain at the developing portion GB. The two-component developer having passed through the developing portion GB is conveyed to the peeling pole N2 (400-500 gausses in magnetic flux density). The peeling pole N2 and the carrying pole N3 have the same polarity and therefore a blank region of the magnetic flux is formed between the peeling pole N2 and the carrying pole N3, so that the two-component developer is dropped from the developing sleeve 40. The magnetic flux blank region is a region in which a magnetic flux density Br with respect to a direction perpendicular to the developing sleeve 40 surface is 10 mT or less and a magnetic flux density bθ with respect to a horizontal direction is 10 mT or less. The two-component developer dropped from the developing sleeve 40 is fed toward the rear side of the drawing sheet surface and flows into the second chamber B through an opening 46*a* shown in (a) and (b) of FIG. 3, thus being delivered to the feeding screw 44.

In the photosensitive drum 4*a* which is the color developing device, at the opposing position to the carrying pole N3 located at the downstream side with respect to the rotational direction of the developing sleeve 40, the layer thickness regulating member regulates the layer thickness of the two-component developer. For this reason, of the excessive two-component developer without being carried on the developing sleeve 40, the two-component developer which cannot be held by the magnetic force of the carrying pole N3 is quickly dropped onto the feeding screw 43. The layer thickness regulating member 42 is disposed between the vertical lowermost point of the developing sleeve 40 and the 90-degree downstream position with respect to the rotational direction of the developing sleeve 40 and therefore the two-component developer which cannot be held by the carrying pole N3 immediately drops onto the feeding screw 43 by gravitation. For this reason, at the upstream side of the layer thickness regulating member 42 with respect to the rotational direction of the developing sleeve 40, a large stagnation portion where the two-component developer is stirred in a magnetic pressure application state is not generated. Incidentally, the downward direction with respect to the gravitational direction in FIG. 4 is the downward direction on the drawing sheet.

<Transparent Image>

Parts (a) and (b) of FIG. 5 are illustrations each for explaining an example of flattening (process) of the image using the transparent image. FIG. 6 is a flow chart of the flattening. FIG. 7 is an illustration of progressions of charge amounts of the color toner and the transparent toner. Incidentally, the flattening is an example of image formation using the transparent toner and also in the case where the transparent toner (image)

is formed for partly providing a gloss difference, a transparent toner use amount tends to become large compared with the color toner.

As shown in (a) of FIG. 5 with reference to FIG. 1, the transparent toner is used for forming a transparent image T for eliminating unevenness (projections and recesses) by uniformizing a height H of a recording image, i.e., heights of respective color images Y, M and C formed on the recording material P and a white background portion. Control of such a flattening is disclosed in JP-A Hei 7-266614. Incidentally, as shown in (b) of FIG. 5, while effecting coating so as to cover the outermost surface layer with the transparent toner, a variation in height of the color toners may also be made flat (height H').

A controller 200 effects, on the basis of height information of the respective color toner images (Y, M, C) on the recording material P, additional recording with the transparent toner image (T) so that the height of the entire image region is uniformized to a maximum (H) of heights of the recording images. The height for uniformizing the entire image region is approximately the maximum (H) of the recording image heights (h1, h2, h3, h4, . . . ). By this, a variation of the fixed images with respect to the height direction is suppressed within 3 μm to substantially smoothen the surfaces of the fixed images, so that recording of a good quality image with uniform gloss is realized.

A maximum amount (per unit area) of the color toners is defined by determining a color reproduction range by a combination of cyan, magenta, yellow and black, and the image is designed so that an amount which is about two times the toner amount with a single-color maximum density is the maximum amount.

Therefore, in order to uniformize the toner amount to the color toner maximum amount, there is a need to effect the image formation with the transparent toner placed on the white background on the recording material in an amount which is about two times the amount corresponding to the color toner maximum density. A calculation of a place and amount of the transparent toner to be placed is made in the following matter.

As shown in FIG. 6, in an image data 102 inputted from an image data reading portion 101, each of RGB signals is recorded at 256 gradation levels correspondingly to each of pixels for the image. This RGB signal for each pixel is converted into a printing amount for each of minimum printing units of the four color toners by an RGB-CMYK converting portion 103. The RGB-CMYK converting portion 103 first converts RGB data into CMY data by 3×3 matrix and thereafter a so-called block component generation by 3×4 matrix is effected to generate K data.

A CMYK toner printing portion 104 controls the image forming portions Pa, Pb, Pc and Pd to form toner images of the respective four colors by the electrophotographic process. At a toner height calculating portion 105, over the whole designated image region, the color toner height for each minimum printing unit is obtained by calculation. A maximum toner height calculating portion 106 obtains a maximum height of the toner images in the designated image region.

At a T toner printing amount calculating portion 107 obtains a difference between the maximum toner height and the color toner height for each minimum printing unit is obtained and is taken as a transparent toner height in the minimum printing unit. Then, an exposure image data of the transparent image for obtaining this height is calculated every minimum printing unit.

A T toner printing portion 108 controls the image forming portion Pe to effect the toner image formation for each minimum printing unit calculated by the T toner printing amount calculating portion 107. The thus image-formed recording material P has a cross-sectional shape shown in FIG. 3 and has a good image quality.

A method of flattening the image surface by the transparent image must form the transparent toner image on the develop 1*e* in the same amount as the maximum toner amount of the color images. There is a need to subject the transparent toner, to development by the developing device 4*e*, in the same amount as the maximum toner amount of the toner image formed by superposition of the toners of the four colors of cyan, magenta, yellow and black. Assuming that the single-color maximum toner amount (per unit area) of the color toners is 0.5 mg/cm$^2$, the developing device 4*e* is required to deposit the transparent toner on the photosensitive drum 1*e* in an amount of 1.0 mg/cm$^2$ or more.

In order to prevent a fog image by continuously placing stably such a transparent toner with a large toner amount, it becomes important to suppress a lowering of a charge amount Q/M of the toner. Therefore, in the image forming apparatus 100, a progression (change) of a distribution of the toner charge amount when a continuous image formation on 30000 sheets with the image flattening by the transparent image was effected was measured. A measurement result is shown in FIG. 7. The abscissa is the charge amount Q/M, and the ordinate is the number of the toner (particles). The toner charge amount distribution is obtained by measuring the charge amount of 3000 toner particles by E-Spart Analyzer manufactured by HOSOKAWA MICRON Corp.

As shown in (a) and (b) of FIG. 7, in order to obtain a glossy image by providing a gloss property to eliminate the surface unevenness, the transparent toner is required to be subjected to development more than the color toner and therefore an initial charge amount Q/M of the transparent toner is made lower than that of the color toner. The transparent toner is placed on the photosensitive drum in a large amount compared with the color toner and therefore the charge amount Q/M of the transparent toner is made lower than that of the color toner. For that reason, the toner content to the developer (T/D ratio) with respect to the transparent toner is set to be higher than that of the color toner. Further, a charging performance of the carrier is deteriorated by cumulation of the image formation and therefore the toner content (T/D ratio) is lowered with the cumulation of the image formation, whereby the toner charge amount Q/M is controlled to a proper value.

As shown in (a) and (b) of FIG. 7, with the cumulation of the image formation, an average triboelectric charge is lowered with respect to both of the color toner and the transparent toner. That is, there is a tendency that a proportion of the toner with an insufficient charge amount (in the neighborhood of zero) is increased by the cumulation of the image formation and thus the toner which is not sufficiently charged in the developing device is increased. Further, with respect to the transparent toner, the proportion of the toner with the insufficient charge amount (in the neighborhood of zero) becomes larger than that of the color toner. That is, it was found that the transparent toner takes part in the development while a newly supplied toner with the image formation is not charged.

When the toner is supplied as required in an amount of consumption with the image formation, the transparent toner is larger in the amount of consumption than the color toner and therefore a supply amount of the transparent toner becomes larger than the supply amount of the color toner. For that reason, the amount of the toner which has to be newly charged is larger for the transparent toner than that for the color toner.

Further, also the amount of an external additive supplied into the developing device with the toner supply is larger for the transparent toner than that for the color toner and therefore in the developing device for the transparent toner, the amount of the external additive liberated from the toner remarkably increases. For this reason, the surface of the carrier contributing to the charging is covered with the external additive to prevent the contact with the toner and therefore a sufficient charge was hard to be imparted to the toner.

Thus, when the image formation is cumulatively effected, the charge amount Q/M of the transparent toner is lowered compared with the color toner. When the charge amount Q/M of the transparent toner is lowered, a problem of the fog image that the toner is deposited on the non-image portion of the photosensitive drum occurs.

It would be often considered that the transparent toner is of no problem even when it is deposited and fixed on the non-image portion of the recording material, but there is a problem that a texture of the recording material becomes dull white by the transparent fog image. When the transparent toner is fogged in a place where the color toner is fogged in a small amount, there is also a problem that such a phenomenon that the fog of the color toner is remarkably conspicuous occurs. For this reason, the fog image should be suppressed with respect to even the transparent toner.

Further, defective cleaning can occur by an increase in fog toner on the photosensitive drum to increase a load on the cleaning blade. In the case where control for reading a quantity of light reflected from the photosensitive drum is effected by using an optical sensor, the reflected light quantity is fluctuated by the fog toner and therefore a measurement error is enlarged to induce erroneous detection of the reflected light quantity. The fog toner is liable to scatter and therefore toner scattering often occurs. When the charge amount Q/M is lowered, the toner amount on the recording material becomes excessive, so that improper fixing can also occur.

Therefore, in the following embodiments, the developing devices for the transparent toner and the color toner are made different from each other to enhance the charging performance with respect to the transparent toner, thereby to prevent the transparent toner fog image even after the cumulation of the image formation.

Embodiment 1

FIG. 8 is an illustration of a vertical cross-sectional structure of the transparent developing device in Embodiment 1.

The developing device 4*e* using the two-component developer using the transparent toner has a planar structure, shown in FIG. 3, which is identical to that of the color developing device 4*a* and therefore will be omitted from redundant description with respect to the planar structure and circulation of the developer.

As shown in FIG. 8, in the developing device 4*e*, the layer thickness regulating member 42 is opposed to the developing sleeve 40 at a position different from that of the color developing device shown in FIG. 4. By this, at the upstream side of the layer thickness regulating member 42 with respect to the rotational direction of the developing sleeve 40, the large stagnation portion where the two-component developer is stirred in the magnetic pressure application state is generated, so that an opportunity of friction of the two-component developer is increased and thus the transparent toner charge amount is enhanced.

The two-component developer 4*e* is made different from the color developing device (4*a*) in structure for carrying the developer in the thin layer on the developer carrying member (40) so that a driving load of the developer carrying member becomes larger than that of the color developing device. Specifically, the layer thickness regulating member 42 is disposed at a position closer to the top (in FIG. 8, the downward direction on the drawing sheet surface is that of the gravitational direction) of the developing sleeve 40 as the developer carrying member than the layer thickness regulating member 42 of the color developing device (4*a*).

Further, the layer thickness regulating member 42 is formed of a magnetic material and is disposed opposed to one of a plurality of magnetic poles of the magnet roller 41. With respect to the transparent developing device (4*e*), a peripheral length of the developer carrying member on which the developer is carried at the upstream side of the layer thickness regulating member 42 by the magnetic poles of the magnet roller 41 is longer than that for the color developing device. With respect to the transparent developing device (4*d*), a peripheral length of the developer carrying member (40) from an opposing position to the feeding screw 43 to an opposing position to the layer thickness regulating member 42 is longer than that for the color developing device (4*a*). Specifically, a developing sleeve peripheral length from the magnetic pole (N3 in FIG. 8) for scooping up the two-component developer in the transparent developing device onto the developing sleeve to the opposing position to the layer thickness regulating member 42 is longer than that for the color developing device. Here, the magnetic pole for scooping up the developer onto the developing sleeve refers to the magnetic pole (N3), of the magnetic poles of the same polarity (N2 and N3 in FIG. 8) disposed along the circumferential direction, at the downstream side with respect to the developing sleeve rotational direction.

Further, with respect to the two-component developer (4*e*), a peripheral length of the developer carrying member (40) from the opposing position to the layer thickness regulating member 42 to the developing position (S-D gap) where the developer carrying member (40) opposes the photosensitive drum 1*e* is shorter than that for the color developing device (4*a*).

The developing sleeve 40 is prepared in a thin pile of the non-magnetic material such as aluminum or stainless steel and rotates in an arrow R4 direction so that its surface moves in the same direction as that of the surface of the photosensitive drum 1*a* at an opposing portion to the photosensitive drum 1*e*. The opposing portion (developing portion) GB between the developing sleeve 40 and the photosensitive drum 1*a* is located between a vertical lowermost point of the developing sleeve 40 to 180-degree upstream point (the downstream direction on the drawing sheet surface is that of the gravitational direction) with respect to the rotational direction of the developing sleeve 40.

Inside the developing sleeve 40, the magnet roller 41 having 5 magnetic poles is provided non-rotatably. The 5 magnetic poles are respective magnetic poles from a main developing pole N1 disposed opposed to the photosensitive drum 1*a*, in the order of a retaining pole S1, a peeling pole N2, a carrying pole N3, and a retaining pole S2 as seen in the rotational direction of the developing sleeve 40.

The layer thickness regulating member 42 is a blade member molded in a 1.5 mm-thick plate-like shape only of a magnetic material. The layer thickness regulating member 42 is disposed at an opposing position to the retaining pole S2 subsequent to the carrying pole N3 by 5 degrees with respect to the rotational direction of the developing sleeve 40 so that it opposes the developing sleeve 40 with a spacing of 640 μm.

The two-component developer in the first chamber A is fed from a rear side to a front side on the drawing sheet surface by the feeding screw 43. At this time, a part of the fed two-component developer is scooped up onto the developing sleeve 40 by being magnetically attracted to the carrying pole N3 of the magnet roller 41.

In the developing device 4*e* which is the transparent developing device, a maximum magnetic flux density at the surface of the developing sleeve 40 at the position of the retaining pole S2 is 620 gausses, and a half-width of the magnetic flux density is 35 degrees. The two-component developer scooped up by being magnetically attracted to the carrying pole N3 is regulated in a layer thickness of about 35 mg/cm$^2$ by the magnetic field between the layer thickness regulating member 42 and the carrying pole N3.

The two-component developer which layer thickness is regulated by the layer thickness regulating member 42 is successively fed from the retaining pole S2 to the main developing pole N1, and is erected at the main developing pole S1 to form a magnetic chain at the developing portion GB. The two-component developer having passed through the developing portion GB is conveyed from the retaining pole S1 to the peeling pole N2 (400-500 gausses in magnetic flux density). A blank region of the magnetic flux is formed between the peeling pole N2 and the carrying pole N3 which have the same polarity, so that the two-component developer is dropped from the developing sleeve 40. The two-component developer dropped from the developing sleeve 40 is fed toward the rear side of the drawing sheet surface and flows into the second chamber B through an opening 46*a* shown in FIG. 3, thus being delivered to the feeding screw 44.

In Embodiment 1, as the developing sleeve 40, a coated sleeve of aluminum was used, and the opposing gap between the developing sleeve 40 and the photosensitive drums 1*a* and 1*d* was set at 350 μm. The developing sleeve 40 was prepared by subjecting the surface of an aluminum bear pipe to blasting using spherical glass particles of FGB #600 and then by subjecting the surface to plating with Ni—B and Cr. A 10-point average surface roughness Razz of the surface of the developing sleeve 40 was 0.6 μm.

The DC voltage Vdc used for the development by being applied to the developing sleeve 40 is −500, and the AC voltage has an amplitude of 1.2 kip measured as the peak-to-peak voltage and has a frequency of 7 kHz.

In Embodiment 1, image design was made in the following manner. The maximum amount (per unit area) of the toner at the time of the single color of the color toners was 0.5 mg/cm$^2$ as 100%. The maximum amount at the time when the full-color image was formed by superposing the toner images of yellow, magenta, cyan and black was 1.0 mg/cm$^2$ as 200% for two colors. On the other hand, the maximum amount of the transparent toner was 1.0 mg/cm$^2$ as 200% for a single color.

Here, a toner charging performance by the developing sleeve of the developing device is compared. First, in a constitution as shown in (b) of FIG. 3, a torque required to rotate only the developing sleeve is detected. Specifically, a driving path (gear train) is changed so as to drive only the developing sleeve of the developing device. By this, the influence of a fluctuation of a torque required to rotate the feeding screw in the developing container can be excluded. Further, in order to accurately grasp a difference between the frictional force and the charging performance due to the change of the constitution in the neighborhood of the developing sleeve, the torque is measured by using the developer with the same ratio between the toner and the carrier in the same amount. Incidentally, when the driving torque of the developing sleeve of the transparent developing device and the driving torque of the developing sleeve of the color developing device are compared, the comparison is made at the same rotational speed of the developing devices.

By this, a magnitude correlation of the charging power (ability) in the neighborhood of the developing sleeves can be compared by the drawing torque. As another method for comparing the charging power by the developing sleeves, a method in which the charge amount of the toner in the developing container is compared when only the developing sleeve is rotationally driven and then rotated for a predetermined time in a state in which the feeding screw for feeding the toner while stirring the toner may also be used. The above methods are the methods for comparing the charging power by changing the constitution in the periphery of the developing sleeve.

Similarly, an evaluation method of the toner charging power of the whole developing device will be described. When the toner charging power of the whole developing device is grasped, evaluation is made on the basis of the driving torque inputted into the whole developing device in a driving path as shown in (a) of FIG. 3.

Specifically, in order to compare the toner charging power of the developing device 4*e*, by taking the amount of the developer accommodated and circulated in the developing device 4*e* as M, taking the driving torque of the developing device as T and taking a rotational angular speed of the drive of the developing device as ω, a parameter which is a condensation W was defined as in the following formula.

$$W=\omega TM$$

When the condensation W is thus defined, the condensation W of the developing device 4*e* for the transparent toner provided in the image forming apparatus is larger than the condensation W of the developing devices 4*a-d* for the color toners.

Incidentally, the charging power of the whole developing device becomes larger with a larger amount M of the circulated developer but when the contained amount of the developer in the two-component developer is made extremely large compared with the color developing devices, it leads to upsizing of the entire image forming apparatus and therefore it is difficult to made an excessive change. Further, the charging power of the whole developing device is improved with an increasing the rotational angular speed ω of the drive. However, when the rotational angular speed ω of the drive is made excessively large, it influences on the toner scattering and the developing property and therefore it is difficult to make an excessive change. Incidentally, the constitutions of the color developing devices and the transparent developing device are the substantially same. Specifically, a distance in which the transparent toner is stirred and conveyed from a transparent toner supply opening of the transparent developing device to the developing sleeve is constituted so as to be substantially identical to a distance in which the color toners are stirred and conveyed from color toner supply openings of the color developing devices to the developing sleeves.

For that reason, the charging power of the transparent developing device is improved by enhancing the torque required for the rotation of the developing sleeve of the transparent developing device and the torques required for the rotations of the developing sleeves of the color developing devices in this embodiment.

In the developing device 4*e* using the transparent toner, the toner consumption amount is large and therefore the amount of the supplied toner is also large. For that reason, in the developing device 4*e*, the amount of the toner which has to be charged per unit time is larger than that in the developing devices 4*a*, 4*b*, 4*c* and 4*d* using the color toners. For this reason, in the case where the transparent toner is used in the same developing device as the developing device 4*a*, with respect to the transparent toner, a proportion in which it is conveyed to the developing position (S-D gap) while being in an insufficient state of the charge amount becomes high.

Further, in the developing device 4*e*, the amount of the toner supplied per unit time is large and therefore a total amount of the external additive which is supplied in mixture with the toner also becomes large, so that an amount of the external additive liberated into the developer also becomes large since the total amount is large. For this reason, the surface of the magnetic carrier contributing to the charging is covered with the external additive, so that the magnetic carrier is liable to become hard to impart the charge to the toner.

Therefore, in the developing device 4*e* using the transparent toner, there is a need to make the condensation W larger than that of the developing device 4*a*. When the condensation W is increased, even when the amount of the toner to be charged is large, it is possible to provide a sufficient friction opportunity to the magnetic charge amount and the non-magnetic toner and thus even after the cumulation of the image formation, it is possible to suppress the lowering in charge amount Q/M of the toner.

That is, when the condensation W is increased, the number of contact between the carrier surface contributing to the charging and the toner is increased and thus the number of transfer of the charges becomes large, so that the toner is easy to have the charges. Further, by increasing the condensation W, a contact area between the carrier surface constituting to the charging and the toner is increased, so that the toner is easy to receive the charges in a larger amount from the carrier surface contributing to the charging.

By increasing the condensation of the developing device 4*e*, the amount (developer stagnation amount) of the developer carried by the developing sleeve 40 in front of the layer thickness regulating member 42 is increased. In the developer stagnation portion formed in front of the layer thickness regulating member 42, the developer receives high pressure and thus the contact area between the carrier surface contributing to the charging and the toner flows actively and therefore the number of contact between the carrier surface contributing to the charging and the toner is increased. By this, the toner is enhanced in charge amount in a short time, so that the charge amount Q/M can be stably maintained.

Even in a state in which the image form is cumulatively effected and the carrier is somewhat contaminated with the external additive of the toner, the friction area is enlarged with the increase in the number of friction between the carrier surface which is not yet contaminated and the toner. For this reason, even by the old carrier subjected to the cumulative image formation, it is possible to properly keep the charge amount Q/M of the newly supplied toner.

Incidentally, in the developing device 4*e* having a strong condensation W, an imparting property of the charge amount Q/M to the toner is high and in an initial state in which a charging site of the carrier is not contaminated, there is a possibility that the toner charge amount Q/M becomes excessively high. When the toner charge amount Q/M becomes excessively high, it becomes difficult to place the toner on the photosensitive drum 1*e* in a desired amount (per unit area) and thus the image density is lowered and therefore, the toner content (T/D ratio) is increased to provide a desired charge amount Q/M.

Further, in the developing devices 4*a*, 4*b*, 4*c* and 4*d* using the color toners, compared with the developing device 4*e*, the toner supply amount per unit time is small and the amount of the toner to be charged is also small and therefore when the same developing device as the developing device 4*e* is used, the toner charge amount Q/M becomes excessively large. For this reason, as shown in FIG. 4, a structure for carrying the developer in the thin layer on the developer carrying member is made different from that of the transparent developing device and thus the condensation W is lowered, so that the driving load of the developer carrying member is made smaller than that of the transparent developing device.

As shown in FIG. 3, in the developing device 4*a*, the feeding screw 43 and the conveying screw 44 are connected to a driving gear 48 for the developing sleeve 40 via gears 49*a* and 49*b*, and the driving gear 48 is connected with a motor 50. For this reason, when the motor 50 rotates the developing sleeve 40, via the gears 48, 49*a* and 49*b*, the feeding screw 43 and the conveying screw 44 are rotated.

In order to measure the driving torque T of the developing device 4*a*, a torque meter 47 is inserted into a spacing between the driving gear 48 and the motor 50. In the case of the developing device 4*a*, the drive of the feeding screw 43 and the conveying screw 44 is integrated with the drive of the developing sleeve 40 and therefore it is possible to measure the whole driving torque T exerted on the developing device 4*a* only at one measuring point of the driving torque.

Incidentally, in the case where the feeding sensor 43 and the conveying screw 44 are separately driven from the developing sleeve 40, each of the driving torques exerted on the developing sleeve 40, the feeding screw 43 and the conveying screw 44 is measured. Then, by adding the driving torques, the whole driving torque exerted on the developing device 4*a* is measured.

First, in a blank state in which the developer is not contained in the developing device 4*a*, the developing device 4*a* is driven at a predetermined number of rotation, so that a driving torque Te of the developing device 4*a* is measured. Then, in a state in which the developer in a predetermined amount is contained in the developing device 4*a* and thereafter the developing device 4*a* is driven at a predetermined number of rotation, a driving torque Tx of the developing device 4*a* is measured. At this time, the driving torque T acting on the developer in the developing device 4*a* is obtained by subtracting the driving torque Te from the driving torque Tx.

$$T=Tx-Te$$

The condensation W was calculated by using the rotational angular speed ω obtained by the thus-obtained torque T, the developer amount M and the predetermined number of rotation. The developer amount m was obtained from the weight of the developer supplied into the developing device 4*a*. As a result, in the developing device 4*e* using the transparent toner, a developer load Wt was 42 (mW/g). Further, in the developing device 4*a* using the color toner, a developer load We was 26 (mW/g).

Therefore, the condensation W of the developing device 4*e* using the transparent toner is higher than the condensation W of the developing device 4*a* using the color toner. That is, the condensation W of the developing device 4*e* with a large amount of toner consumption is made higher than condensations W of other developing devices 4*a*, 4*b*, 4*c* and 4*d* with small amounts of toner consumption.

Incidentally, in an experiment of Embodiment 1, it was confirmed that the driving torque T can also be changed by changing the surface roughness of the developing sleeve 40.

Therefore, the surface roughness of the developing sleeve 40*e* as the developer carrying member provided in the developing device 4*e* for the transparent toner was made rougher than the surface roughness values of the developing sleeves

40*a*-40*d* as the developer carrying member provided in the developing devices 4*a*-4*d* for the color toners. By this, the torque required for rotationally driving the developing sleeve as the developer carrying member for the transparent developing device 4*e* can be made larger than the torques required for rotationally driving the developing sleeves for the color developing devices 4*a*-4*d*.

Specifically, the 10-point average roughness Razz of the developing sleeve 40*a* of the color developing device was 0.6 μm, the developing sleeve 40*e* of the transparent developing device was subjected to the surface plating with Ni—B and Cr and thereafter was subjected to a high-friction providing process (specifically, knurling), thus having the 10-point average roughness Razz of 2.2 μm. Incidentally, as a measuring method of the torque required for the drive, a measuring method such that a torque fluctuation required for driving the stirring screw in the developing device was ignorable by the constitution shown in (b) of FIG. 3 was used.

By this, without changing the cross-sectional structures of the developing device 4*e* for the transparent toner and the color developing devices 4*a*-*d*, the toner charging power of the transparent developing device can be made higher than the toner charging powers of the color developing devices. Such a constitution in which the sleeve surface roughness is easy to be changed but on the other hand, there is also an aspect such that it is difficult to change extremely the surface roughness since the constitution influences the developing property. For that reason, it is preferable that the sleeve surface roughness is made a proper surface roughness with respect to the color developing devices in which the lowering in developing property directly leads to the image quality, and at the same time, the sleeve surface roughness of the transparent developing device is set so as to be rough on the basis of the sleeve roughness of the color developing devices.

Further, in the experiment in Embodiment 1, it was confirmed that the amount of the liberated external additive was not changed even when the condensation of the developing device 4*e* was increased, and the amount of the liberated external additive wholly depended on the supplied toner amount.

Incidentally, the condensation W of the transparent toner developing device 4*e* is higher than the condensation W of the color toner developing device 4*a* and therefore also in consideration of that fact, an initial toner content (T/D ratio) is set to be higher than that of the color toners. That is, when the weight ratio of the toner to the developer which is accommodated and circulated in the developing device is T/D, T/D of the transparent developing device is larger than T/D of the color developing devices.

Further, the transparent toner is used for eliminating a stepped portion of the color images on the recording material and thus is higher in image ratio than the color toners and the amount of toner consumption per unit time is larger than those of the color toners. For this reason, the toner in the developing device 4*e* is frequently replaced, so that the toner little remains in the developing device 4*e* for a long term. On the other hand, the yellow toner, the magenta toner and the cyan toner are small in toner consumption amount compared with the transparent toner and therefore remain in the developing devices 4*a*, 4*b* and 4*c* for a long term. The toners remain in the developing devices 4*a*, 4*b* and 4*c* for a long term and thus toner deteriorations such as toner cracking and burying of the external additive or the like are generated.

For this reason, in the developing device 4*e*, a carrier deterioration by the external additive progresses, while the toner is little deteriorated. On the other hand, in the developing devices 4*a*, 4*b* and 4*c*, the toner deteriorations progress by circulation of the developers for a long time while being stirred, while the carrier is not so deteriorated since the amount of the supply of the external additive is small.

That is, in the developing devices 4*a*, 4*b* and 4*c*, the carrier is hard to be deteriorated and therefore the fog image is not readily generated even when the condensation W of the developing device is low. Further, in the developing devices 4*a*, 4*b* and 4*c*, as described above, the charge amount Q/M is made high compared with the developing device 4*e* and therefore even when the condensation W of the developing device is low, the fog image is hard to generate. On the other hand, even the condensation W is made high in the developing devices 4*a*, 4*b* and 4*c*, a toner retention time in the developing devices is long and therefore the number of toner friction is remarkably increased, so that the toner deteriorations become serious. For this reason, it is desirable that the condensation W is lowered in the developing devices 4*a*, 4*b* and 4*c* and is raised in the developing device 4*e*.

<Experiment 1>

FIG. 9 is an illustration of a relationship between the condensation and the toner charge amount.

The condensation W is changed in the developing device 4*e*, and with respect to each of the respective values of the condensation W, image formation on 1000 sheets was effected and the toner charge amount Q/M was measured and compared.

The values of the condensation ($W=\omega TM$) were set respectively by changing the rotational angular speed ω of the developer carrying member. The toner charge amount Q/M was measured by E-Spart Analyzer manufactured by HOSOKAWA MICRON Corp. by taking the developer from the developing sleeve 40 after the image formation.

With respect to the carrier and the toner, the above-described two-component developer in a brand-new state was used, and the experiment was conducted at the toner content (T/D ratio) of 8%.

As shown in FIG. 9, when the condensation W Of the developing device 4*e* is increased, the toner charge amount Q/M can be increased, and by this, it was confirmed that the charging power, as the developing device, with respect to the toner was enhanced. Here, with respect to the developing device 4*e*, not only the condensation W but also the torque, required for rotating only the developing sleeve at a predetermined angular speed, obtained by being changed as in the constitution of (b) of FIG. 3 is larger than torque required for rotating the developing sleeves of the color developing devices at a predetermined angular speed.

FIG. 10 is an illustration of progressions of toner charge amounts compared based on a difference in developing device. FIG. 11 is an illustration of a durability experiment in which the image flattening is effected by developing devices in Embodiment 1.

When continuous image formation is effected with the developing device 4*e* having a low condensation W in a state in which the carrier is contaminated with the external additive, the toner charge amount Q/M cannot be enhanced sufficiently and therefore defective image of white background fog is generated from some midpoint of the continuous image formation.

In order to eliminate the stepped portion of the toner, assuming that the image formation with an image ratio of 50% is effected by using the transparent toner, a durability experiment of the developing device 4*e* as the transparent developing device and the developing device 4*a* as the color developing device was conducted. The durability experiment in which the magenta toner was filled and supplied into the developing device 4*a* and then the image formation with the image ratio of 50% was continuously effected on 50000 sheets by using only the image forming portion Pa in the image forming apparatus 100 shown in FIG. 1. Further, the durability experiment in which similarly the magenta toner was filled and supplied into the developing device 4*e* and then the image formation with the image ratio of 50% was continuously effected on 50000 sheets by using only the image forming portion Pd. Then, a state of the generation of the fog image and the progression of the toner charge amount Q/M during the durability experiment were measured.

The toner charge amount Q/M was measured in the same manner as in Embodiment 1 by taking the developer from the developing sleeve 40 at respective stages during the durability experiment. The density of the fog image was measured in the following manner by using a reflection density meter (REFLECTOMETER MODEL TC-6DS manufactured by TOKYO DENSHOKU CO., LTD.). When a 5-point average of magenta reflection density at the white background portion after printing was Ds and the 5-point average of magenta reflection density at the white background portion before printing was Dr, Ds−Dr was evaluated. With a smaller this value, the amount of the toner deposition at the white background portion is smaller. The transparent toner does not respond to the reflection density meter and therefore was replaced with the magenta toner. Then, with respect to the toner image density at the white background portion of the image after the fixing, 2.5% or less of the maximum density image was evaluated as fair and 2.5% or more of the maximum density image was evaluated as unacceptable (generation of the fog image). When the amount of white background fog of the image after the fixing was 2.5% or less in terms of the density on the recording material, the image was judged that the fog image was not generated.

As shown in FIG. 10, in the developing device 4*a* as the color developing device, the toner charge amount Q/M was largely lowered with the cumulation of the image formation. When the toner was outputted in the image formation with the image ratio of 50%, the charge amount Q/M of the newly supplied toner was not able to be enhanced sufficiently and therefore the toner charge amount Q/M was lowered at some midpoint of the durability experiment. Then, when the number of sheets subjected to cumulative image formation was 30000 sheets, it was confirmed that the fog image was generated. By this, with respect to the developing device 4*a*, it was confirmed that the charging performance was not able to overtake the image formation in which the transparent image was formed with the image ratio of 50% to eliminate the stepped portion of the toner.

On the other hand, with respect to the developing device 4*e* as the transparent developing device, even under the same image forming condition, compared with the case where the developing device 4*a* was used, the lowering in the toner charge amount Q/M during the durability experiment was suppressed. Even when the toner was outputted in the image formation with the image ratio of 50%, also the newly supplied transparent toner could enhance the charge amount Q/M sufficiently. Further, also after the cumulative image formation on 50000 sheets was effected, the fog image was not generated. By this, with respect to the developing device 4*e*, it was confirmed that a sufficient charging performance is achieved in the image formation in which the transparent image was formed with the image ratio of 50% to eliminate the stepped portion of the toner.

The developing device 4*e* in Embodiment 1 was mounted in the image forming apparatus 100 shown in FIG. 1 and then the durability experiment of the continuous image formation with the flattening of the image by the transparent image was conducted.

As shown in FIG. 11, by employing the developing device 4*e* in Embodiment 1, the lowering in toner charge amount Q/M could be uniformed substantially equally in the transparent toner developing device 4*e* with the large toner consumption amount and in the color toner developing device 4*a* with the small toner consumption amount. By this, even when the image formation with the high image ratio using the transparent toner was continued, the lowering in toner charge amount Q/M could be suppressed to prevent the generation of the fog image.

Embodiment 2

In Embodiment 1, only the toner was supplied into the developing device but in Embodiment 2, the deteriorated developer is discharged little by little from the developing device and then the toner containing the carrier in a predetermined proportion is supplied into the developing device.

A method in which the deteriorated developer is collected little by little from the developing device and then a supply developer is newly supplied correspondingly and thus time and effort of exchange of the developer are saved while maintaining the performance of the developer to some extent has been put into practical use. By gradually replacing the deteriorated developer (carrier) with a new one, apparent progress of the carrier deterioration is stopped. Then, a characteristic of the developer as a whole is stabilized and further the developer is automatically exchanged, so that lifetime extension of the developer can be realized and an operation of the developer exchange can be unnecessitated to some extent. Such a developing device and supply control of the supply developer are disclosed in, e.g JP-B 2-21591.

In the case where the image with a high image ratio is continuously outputted as in the case of the developing device for the transparent toner, the toner consumption amount is large compared with the image with a low image ratio, the number of supply of the toner to the developing device is increased. For this reason, the amount of the carrier supplied into the developing device is also increased.

Therefore, by using the developing device with the condensation W of 30 (mW/g) and by using the supply developer with the toner content (T/D ratio) of 85%, similarly as in the above-described experiment 2, the durability experiment for effecting the continuous image formation with the image ratio of 50% was conducted. As a result, compared with the case where there is no charge amount supply, it was confirmed that the lowering in toner charge amount Q/M in the developing device with the cumulation of the image formation became slow but the fog image was generated from the neighborhood of the cumulative sheet number exceeding 150000 sheets. The toner charge amount Q/M immediately after start of the durability experiment was 20 μC/g, but on the other hand, at the time when the cumulative sheet number of image formation reached 150000 sheets, the toner charge amount Q/M was lowered to 8 μC/g, which was ½ or less.

That is, in the case where the image formation with the high image ratio is continued, the toner consumption amount is large compared with the image with the low image ratio and therefore the number of the toner supply is increased and thus the amount of the carrier supplied into the developing device is also increased. However, even when the charge amount is refreshed by the supplied carrier, in the case where the image ratio is high, the influence of the external additive which is liberated from the toner and is accumulated in the developing device exceeds (a degree of the refreshing of the carrier) and thus the carrier deterioration becomes problematic.

That is, in the case where the image ratio is low, a relationship of "(degree of refreshing by carrier replacement)>(degree of deterioration of external additive due to accumulation) is satisfied, but in the case where the image ratio is high, a relationship of "(degree of deterioration of external additive due to accumulation)>(degree of refreshing by carrier replacement) is satisfied.

For that reason, in the case where the image ratio is high, the developer is deteriorated although the carrier is replaced little by little. A sufficient charge amount Q/M cannot be imparted to the supplied toner, so that the toner scattering and the fog image can occur and the improper fixing due to an excessive toner amount (per unit area) on the recording material can occur.

For that reason, even with respect to the developing device for discharging the deteriorated developer and for supplying the developer for supply containing the carrier, in order to suppress the lowering in charge amount Q/M of the supplied toner, it is desirable that the condensation W Of the developing device is enhanced.

Therefore, as shown in FIG. 8, by using the developing device 4*e* in which the condensation W was enhanced to 38 (mW/g), the durability experiment was conducted similarly as in the case of the developing device with the condensation W of 30 (mW/g). As a result, the lowering in toner charge amount Q/M with the cumulation of the image formation was suppressed, so that the fog image was not generated even when the number of cumulative sheets of the image formation exceeds 200000.

Incidentally, if the supply amount of the carrier is increased by further lowering the toner content (T/D ratio) of the supply developer than 85%, even in the developing device with the condensation W of 30 (mW/g), the lowering in toner charge amount Q/M can be suppressed. However, when the supplied carrier is increased over the supplied developer, the amount of the developer discharged from the developing device is also increased and therefore is uneconomical. A running cost is increased and the decrease in developer for supply becomes early to increase a frequency of exchange of the developer supply container, thus being unpreferable from the viewpoint of serviceability.

Therefore, also in a system in which the charge amount supply as in Embodiment 2 is effected, with respect to the developing device using the transparent toner, the condensation W of the developing device is made higher than that of the developing device using the color toner, so that the generation of the fog image can be prevented.

Embodiment 3

FIG. 12 is an illustration of a structure of a layer thickness regulating member in a developing device in Embodiment 3. FIG. 13 is an illustration of progressions of charge amounts Q/M of toners in Embodiment 3. Parts (a) and (b) of FIG. 14 are illustrations of relationships each between a length of a non-magnetic developing blade and an amount of magnetic flux. FIG. 15 is an illustration of a durability experiment in which the image flattening is effected by developing devices in Embodiment 3.

As shown in FIG. 12, a layer thickness regulating member 42 is constituted by bonding a magnetic developing blade 42*a* constituted by an iron and nickel compound to the end of a non-magnetic developing blade 42*b* of an aluminum plate.

In Embodiment 3, the transparent toner developing device 4*e* shown in FIG. 1 was made identical to the color toner developing device 4*a* shown in FIG. 4. Incidentally, a distance between the developing sleeve of the color developing device and the layer thickness regulating member is equal to a distance between the developing sleeve of the transparent developing device and the layer thickness regulating member. However, with respect to the transparent toner developing device 4*e*, a length Lb of the magnetic developing blade 42*a* is made larger than those of the color toner developing devices 4*a*, 4*b*, 4*c* and 4*d*, so that a strong magnetic field was formed between the blade 42*a* and the magnetic roller 41. That is, the layer thickness regulating member (42*a*) is formed of the magnetic material and is disposed opposed to one of a plurality of magnetic poles of the magnetic roller 41. In the transparent developing device (4*e*), an amount of magnetic flux formed between the layer thickness regulating member (42*a*) and one magnetic pole (S2) is larger than those in the color developing devices. The arrangement of the layer thickness regulating member 42 was made equal and only the length (Lb) was changed, so that the torque required for rotating the developing sleeve of the transparent developing device 4*e* at a predetermined speed was made larger than the torques required for rotating the developing sleeves of the color developing devices 4*a*-4*d*. Further, similarly, the condensation W of the developing device 4*e* was made higher than the values of the condensation W of the developing devices 4*a*, 4*b*, 4*c* and 4*d*. In the following, when the condensation is discussed, with respect at least the torque required for rotating only the developing sleeve, the torque required for rotating the developing sleeve provided in the two-component developer is higher.

Specifically, in the transparent toner developing device 4*e*, the length Lb of the magnetic developing blade 42*a* was 6 (mm), and the length Lb of the magnetic developing blade 42*a* in each of the color toner developing devices 4*a*, 4*b*, 4*c* and 4*d* was 3 (mm).

As shown in FIG. 3, the torque meter 47 was inserted between the driving gear 48 for the developing device 4*e* and the motor 50, and the driving torques of the developing devices 4*a* and 4*e* were measured and compared. As a result, only by the difference in the length of the layer thickness regulating member 42, the transparent toner developing device 4*e* had the condensation W of 38 (mW/g) which was higher than the condensation W of 28 (mW/g) for the color toner developing device 4*a*. By this, in the transparent toner developing device 4*e*, the condensation W was made higher than that of the color toner developing device 4*a*, so that the lowering in toner charge amount Q/M was suppressed even in the continuous image formation with the high image ratio.

By using the developing device 4*e* with the condensation W of 38 (mW/g) and the developing device 4*a* with the condensation W of 28 (mW/g), similarly as in the experiment 2 in Embodiment 1, the durability experiment for effecting the continuous image formation for magenta with the image ratio of 50% was conducted. As shown in FIG. 13, as a result, in the case of the developing device 4*a* with the condensation W of 28 (mW/g), it was confirmed that the toner charge amount Q/M in the developing device was lowered with the cumulation of the image formation and the fog image was generated from the neighborhood of the cumulative sheet number exceeding 35000 sheets. The toner charge amount Q/M immediately after start of the durability experiment was 20 μC/g, but on the other hand, at the time when the cumulative sheet number of image formation reached 40000 sheets, the toner charge amount Q/M was lowered to 8 μC/g, which was ½ or less.

On the other hand, in the case of the developing device 4*e* with the condensation W of 38 (mW/g), by only the slight difference in length of the layer thickness regulating member 42, the lowering in toner charge amount Q/M in the developing device with the cumulation of the image formation was suppressed. Further, even when the cumulative sheet number exceeded 50000 sheets, the toner charge amount Q/M was 12 μC/g and the fog image was not generated.

The reason for the change in developer stagnation amount when the length Lb of the magnetic developing blade 42*a* is changed is as follows.

As shown in (a) of FIG. 14, when the length Lb of the magnetic developing blade 42*a* is long, the magnetic lines of force extend from the carrying pole S2 of the magnet roller 41 to the neighborhood of the partition wall 46, and the magnetic developing blade 42*a* and the developer are the magnetic material and therefore the developer stagnation portion can be formed until the neighborhood of the partition wall 46.

On the other hand, as shown in (b) of FIG. 13, when the length Lb of the magnetic developing blade 42*a* was short, the magnetic lines of force from the carrying pole S2 cannot extend to the neighborhood of the partition wall 46, so that the developer is not stagnated until the neighborhood of the partition wall 46. For that reason, the developer stagnation amount the upstream side of the magnetic developing blade 42*a* becomes small compared with that when the magnetic developing blade 42*a* is long.

For this reason, by the change in condensation depending on the length Lb of the magnetic developing blade 42*a*, the developer stagnation amount is changed and thus there arises a difference in work of friction acting on the developer stirred in the developer stagnation portion, so that the charging performance to the toner becomes different. As described above, the torque required for rotating the developing sleeve of the transparent developing device 4*e* at the predetermined speed is constituted so as to become larger than the torque required for rotating the developing sleeve of the color developing device. That is, the amount of triboelectric charge effected at the developer stagnation portion of the transparent developing device 4*e* is larger than the amount of triboelectric charge effected at the developer stagnation portion of the color developing device.

As described above, in Embodiment 3, in the transparent toner developing device 4*e*, the length Lb of the magnetic developing blade 42*a* is made longer than that in the color toner developing device 4*a*. By this, the developer stagnation portion is formed until the neighborhood of the partition wall 46, so that there arises a difference in compressed state of the developer in the developer stagnation portion.

Incidentally, in Embodiment 3, the length of the magnetic developing blade 42*a* is changed by the present invention is not limited thereto. For example, the magnetic developing blade 42*a* may be provided in only the transparent toner developing device 4*e* and may also be so as not to be provided in the color toner developing device 4*a*. Or, the thickness of the magnetic developing blade 42*a* may also be made different between the transparent toner developing device 4*e* and the color toner developing device 4*a*. The permeability of the magnetic developing blade may also be made different between the transparent toner developing device 4*e* and the color toner developing device 4*a*. By this, a magnetic confining force of the charge amount between the developing sleeve and the magnetic blade can be enhanced, with the result that the toner charging power in the neighborhood of the developing sleeve can be enhanced. Naturally, even when the permeability of the material for the sleeve or the like is changed, a constitution may also be changed so long as the magnetic confining force can be similarly enhanced.

The developing device 4*e* in Embodiment 3 was mounted in the image forming apparatus 100 shown in FIG. 1 and then the durability experiment of the continuous image formation with the flattening of the image by the transparent image was conducted.

As shown in FIG. 15, by employing the developing device 4*e* in Embodiment 3, amount and in the color toner developing device 4*a* with the small toner consumption amount. By this, even when the image formation with the high image ratio using the transparent toner was continued, the lowering in toner charge amount Q/M could be suppressed to prevent the generation of the fog image.

Incidentally, similarly as in Embodiment 2, also in a system in which the deteriorated developer is collected little by little from the developing device and on the other hand a supply developer containing the carrier correspondingly, the developing device in Embodiment 3 can be used.

Embodiment 4

FIG. 16 is an illustration of progressions of charge amounts Q/M of toners in Embodiment 4. FIG. 17 is an illustration of a durability experiment in which the image flattening is effected by developing devices in Embodiment 4.

In Embodiment 3, by enhancing a strength of magnetization of the magnetic poles of the magnet roller 41 opposing the magnetic developing blade 42*a*, similarly as in Embodiment 3, the developer stagnation portion is enlarged, so that the condensation W of the developing device is enhanced. More specifically, the torque required for rotating the developing sleeve of the transparent developing device 4*e* at the predetermined speed is made larger than the torque required for rotating the developing sleeves of the color developing device 4*a-d* at the predetermined speed.

In Embodiment 4, the transparent toner developing device 4*e* shown in FIG. 1 was made identical to the color toner developing device 4*a* shown in FIG. 4. However, in the transparent developing device (4*e*), a density of magnetic flux formed between the layer thickness regulating member (42*a*) and the opposing magnetic pole is higher than that in the color developing device (4*a*). For that reason, with respect to the transparent toner developing device 4*e*, the magnetization of the magnetic pole of the magnet roller 41 was strengthened, so that a large developer stagnation portion was formed at the upstream side of the magnetic developing blade 42*a*.

As shown in FIG. 4, the magnet roller 41 for forming a predetermined magnetic force distribution is incorporated in the developing sleeve 40, so that the developer is carried on the developing sleeve 40 by the magnetic field of the magnet roller 41. The developer is attracted by the scooping pole N3 and is scooped up by the developing sleeve 40, and then is regulated in a certain layer thickness by the magnetic developing blade 42*a*.

In Embodiment 4, the gauss of the scooping pole N3 is made stronger in the transparent toner developing device 4*e* than that in the color toner developing device 4*a*. Specifically, the gauss of the scooping pole N3 was 680 (G) in the transparent toner developing device 4*e* and was 550 (G) in the color toner developing device 4*a*.

When the gauss of the magnetic pole of the magnet roller 41 is weakened, the magnetic force at the surface of the developing sleeve 40 is weakened. Then, the amount of the developer which can be carried on the developing sleeve 40 is decreased, so that the amount of the developer stagnation at the upstream side of the magnetic developing blade 42*a* is decreased. For this reason, by enhancing the gauss of the scooping pole N3, in the transparent toner developing device 4*e*, the developer stagnation portion larger than that in the color toner developing device 4*a* can be formed to increase stirring work with respect to the developer.

With respect to the thus-constituted transparent toner 4*e* and color toner developing device 4*a*, the driving torques of the developing devices 4*a* and 4*e* were measured to obtain the condensation W as shown in FIG. 3. As a result, the transparent toner developing device 4*e* had the condensation W of 36 (mW/g) which was higher than the condensation W of 28 (mW/g) for the color toner developing device 4*a*.

By using the developing device 4*e* with the condensation W of 36 (mW/g) and the developing device 4*a* with the condensation W of 28 (mW/g), similarly as in the experiment 2 in Embodiment 1, the durability experiment for effecting the continuous image formation for magenta with the image ratio of 50% was conducted. As shown in FIG. 16, as a result, in the case of the developing device 4*a* with the condensation W of 28 (mW/g), it was confirmed that the toner charge amount Q/M in the developing device was lowered with the cumulation of the image formation and the fog image was generated from the neighborhood of the cumulative sheet number exceeding 30000 sheets. The toner charge amount Q/M immediately after start of the durability experiment was 20 μC/g, but on the other hand, at the time when the cumulative sheet number of image formation reached 40000 sheets, the toner charge amount Q/M was lowered to 8 μC/g, which was ½ or less.

On the other hand, in the case of the developing device 4*e* with the condensation W of 36 (mW/g), by only the difference in magnetization of the magnet roller 41, the lowering in toner charge amount Q/M in the developing device with the cumulation of the image formation was suppressed. Further, even when the cumulative sheet number exceeded 50000 sheets, the toner charge amount Q/M was 12 μC/g and the fog image was not generated.

The developing device 4*e* in Embodiment 3 was mounted in the image forming apparatus 100 shown in FIG. 1 and then the durability experiment of the continuous image formation with the flattening of the image by the transparent image was conducted.

As shown in FIG. 16, by employing the developing device 4*e* in Embodiment 3, amount and in the color toner developing device 4*a* with the small toner consumption amount. By this, even when the image formation with the high image ratio using the transparent toner was continued, the lowering in toner charge amount Q/M could be suppressed to prevent the generation of the fog image.

Incidentally, similarly as in Embodiment 2, also in a system in which the deteriorated developer is collected little by little from the developing device and on the other hand a supply developer containing the carrier correspondingly, the developing device in Embodiment 3 can be used.

The developing device 4*e* in Embodiment 4 was mounted in the image forming apparatus 100 shown in FIG. 1 and then the durability experiment of the continuous image formation with the flattening of the image by the transparent image was conducted.

As shown in FIG. 17, by employing the developing device 4*e* in Embodiment 4, amount and in the color toner developing device 4*a* with the small toner consumption amount. By this, even when the image formation with the high image ratio using the transparent toner was continued, the lowering in toner charge amount Q/M could be suppressed to prevent the generation of the fog image.

Incidentally, similarly as in Embodiment 2, also in a system in which the deteriorated developer is collected little by little from the developing device and on the other hand a supply developer containing the carrier correspondingly, the developing device in Embodiment 4 can be used.

Embodiment 5

FIG. 18 is an illustration of a structure of an image forming apparatus in Embodiment 5.

In Embodiment 1 to Embodiment 4, the embodiments of the image forming apparatus of the direct transfer type shown in FIG. 1 were described. However, in the present invention, the developing devices in Embodiments 1-4 can be mounted also in the image forming apparatus of an intermediary transfer type.

As shown in FIG. 18, the image forming apparatus 100 is an intermediary transfer type full-color printer of the tandem type in which image forming portions Pa for yellow, Pb for magenta, Pc for cyan, Pd for black and Pe for clear are disposed along an intermediary transfer belt 7A (image receiving member, image carrying member).

At the image forming portion Pa, a yellow toner image is formed on a photosensitive drum 1*a* and then is primary-transferred onto a recording material carried on the intermediary transfer belt 7A. At the image forming portion Pb, a magenta toner image is formed on a photosensitive drum 1*b* and then is primary-transferred superposedly onto the yellow toner image on the intermediary transfer belt 7A. At the image forming portions Pc and Pd, a cyan toner image and a black toner image are formed on a photosensitive drum 1*c* and a photosensitive drum 1*d*, respectively, and are similarly primary-transferred superposedly onto the intermediary transfer belt 7A.

The four color toner images carried on the intermediary transfer belt 7A are conveyed to a secondary transfer portion T2 with the rotation of the intermediary transfer belt 7A<and are collectively secondary-transferred onto the recording material P. The recording material P on which a full-color toner image is transferred is curvature-separated from the intermediary transfer belt 7A at a curved surface of a separation roller 81 and is subjected to heating and pressing by a fixing device 9 to fix the toner images on its surface and thereafter is discharged onto a discharge tray 14 outside the apparatus.

The image forming portions Pa, Pb, Pc, Pd and Pe are constituted equally to those of the image forming apparatus 100 in FIG. 1. Further, the driving torque required for rotating the developing sleeve as the developer carrying member of the transparent toner developing device 4*e* as the transparent developing device is higher than the driving torques required for rotating the developing sleeves as the developer carrying member of the color toner developing devices 4*a*-4*d* as the color developing device.

This can be, as described in Embodiments 1-4, achieved by changing the magnetic pole arrangement or magnetic pole strength of the fixed magnet of the developing device, the permeability and shape of the layer thickness regulating member, or the friction coefficient (surface roughness) of the sleeve surface and any of these may also be combined.

Further, the condensation W of the transparent toner developing device 4*e* is made higher than values of the condensation W of the color toner developing devices 4*a*, 4*b*, 4*c* and 4*d*. A specific method for enhancing the condensation W is as described in Embodiments 1-4. As described above, the condensation W can be changed by the rotational speed of the sleeve and the volume of the toner which can be accommodated in the developing container. However, when the sleeve rotational speeds of the color developing devices and the transparent developing device are largely changed, problems such as improper development of the electrostatic image and the scattering of the toner carried on the sleeve occur and therefore are unpreferable.

Similarly, when the amount of the developer accommodated in the developing container is largely changed, the charge amount of the toner in the developing device becomes unstable to cause the image defect or to invite upsizing of the apparatus due to increase of the volume of the developing container and therefore is unpreferable.

For that reason, while making at least the torque required for the rotational drive of the sleeve of the transparent developing device larger than the torque required for the rotational drive of the sleeve of the color developing device, the respective developing devices are further constituted so that the condensation W of the transparent developing device is not below the condensation W of the color developing device.

By this, also in the image forming apparatus 100A in Embodiment 5, the lowering in charge amount Q/N of the transparent toner with the cumulation of the image formation is suppressed. As a result, without inviting the generation of the fog image, the high-quality image can be stably formed.

Embodiment 6

From Embodiment 1 to Embodiment 5, the constitution in which the transparent developing device and the color developing devices were included in the single image forming apparatus was described. However, an apparatus including the transparent developing device and an apparatus including the color developing devices may also be separate apparatuses. Specifically, such a constitution as shown in FIG. 19 may also be used. FIG. 19 is a view showing a schematic structure of the image forming apparatus in this embodiment. By connecting a color image forming apparatus 100B and a transparent image forming apparatus 100C, an image forming apparatus (system) in the present case is constituted.

The upstream-side color image forming apparatus 100B includes color image forming portions and includes color toner developing devices 4*a*-4*d*. Then, the toner images formed at the respective color image forming portions are superposed on the recording material, and the toner images are fixed on the recording material by a fixing device 9B. The recording material subjected to the fixing by the fixing device 9B is conveyed to the transparent image forming apparatus 100C disposed downstream of the color image forming apparatus 100B.

The transparent image forming apparatus 100C transfers the transparent toner image onto the recording material, on which the color toners are fixed, by a transparent image forming portion (1*e*-6*e*). Further, the transparent toner image formed on the recording material is fixed on the recording material by a fixing device 9C.

Also in such a constitution, in the case where the image formation in which the transparent toner is consumed in a large amount as in the flattening described in Embodiment 1, similarly, it becomes difficult to keep the charge amount of the transparent toner inside the developing device 4*e* for the transparent toner so as to provide a desired distribution. For that reason, the driving torque required for rotating the sleeve as the developer carrying member of the developing device 4*e* for the transparent toner in this embodiment is constituted so as to become higher than the driving torques required for rotating the sleeves as the developer carrying member of the developing devices 4*a*-4*d*.

By this, in the image forming apparatus (image forming system) consisting of the image forming apparatuses 100B and 100C described in Embodiment 6, the lowering in charge amount Q/M of the transparent toner with the cumulation of the image formation is suppressed. As a result, without inviting the generation of the fog image, the high-quality image can be stably formed.

The present invention is not limited to the above-described embodiments but various changes and modifications can be made without deviating from the spirit and scope of the present invention. Therefore, in order to make the scope of the present invention public, the following claims are attached.

The present application claims priority on the basis of Japanese Patent Application 2009-209343, and all of the contents of the description of the application are incorporated by reference.

INDUSTRIAL APPLICABILITY

In the case where the amount of use of the transparent toner is large compared with the color toners, the scattering of the transparent toner generated by conveyance of the transparent toner, with a smaller charge amount than a desired charge amount, to the neighborhood of the developing sleeve can be suppressed.

The invention claimed is:

1. An image forming apparatus comprising:

a color developing device for developing with a color toner an electrostatic image formed on a photosensitive member, said color developing device including a fixed magnet provided with a plurality of magnetic poles, a developer carrying member which is rotated around the fixed magnet and carries a color developer comprising a color toner and a carrier, and a layer thickness regulating member which is provided opposed to the developer carrying member and regulates a layer thickness of the carried color developer; and a transparent developing device for developing with a transparent toner an electrostatic image formed on a photosensitive member, said transparent developing device including a fixed magnet provided with a plurality of magnetic poles, a developer carrying member which is rotated around the fixed magnet and carries a transparent developer comprising a transparent toner and a carrier, and a layer thickness regulating member which is provided opposed to the developer carrying member and regulates a layer thickness of the carried transparent developer, wherein a distance from a downstream one of adjacent magnetic poles of the same polarity of the fixed magnet of said transparent developing device with respect to a developer carrying member rotational direction to a position opposing the layer thickness regulating member is longer than a distance from a downstream one of adjacent magnetic poles of the same polarity of the fixed magnet of said color developing device with respect to the developer carrying member rotational direction to the position opposing the layer thickness regulating member.

2. An image forming apparatus comprising:

a color developing device for developing with a color toner an electrostatic image formed on a photosensitive member, said color developing device including a fixed magnet provided with a plurality of magnetic poles, a developer carrying member which is rotated around the fixed magnet and carries a color developer comprising a color toner and a carrier, and a layer thickness regulating member which is provided opposed to the developer carrying member and regulates a layer thickness of the carried color developer; and a transparent developing device for developing with a transparent toner an electrostatic image formed on a photosensitive member, said transparent developing device including a fixed magnet provided with a plurality of magnetic poles, a developer carrying member which is rotated around the fixed magnet and carries a transparent developer comprising a transparent toner and a carrier, and a layer thickness regulating member which is provided opposed to the developer carrying member and regulates a layer thickness of the carried transparent developer, wherein a magnetic confining force between the layer thickness regulating member of said transparent developing device and a magnetic pole of the fixed magnet provided at an upstream side with respect to a developer carrying member rotational direction is larger than a magnetic confining force between the layer thickness regulating member of said color developing device and a magnetic pole of the fixed magnet provided at an upstream side with respect to the developer carrying member rotational direction.

3. An image forming apparatus according to claim 1, wherein a permeability of the layer thickness regulating member of said transparent developing device is higher than a permeability of the layer thickness regulating member of said color developing device.

4. An image forming apparatus according to claim 1, wherein a carrier attracting force of the layer thickness regulating member of said transparent developing device and the magnetic pole of the fixed magnet provided at the upstream side with respect to the developer carrying member rotational direction is larger than a charge attracting force of the layer thickness regulating member of said transparent developing device and the magnetic pole of the fixed magnet provided at the upstream side with respect to the developer carrying member rotational direction.

5. An image forming apparatus according to claim 1, wherein a surface roughness of the developer carrying member of said transparent developing device is rougher than a surface roughness of the developer carrying member of said color developing device.

6. An image forming apparatus according claim 1, wherein a product of an amount of the transparent developer accommodated and circulated in said transparent developing device, a driving torque for driving said transparent developing device and an angular speed of driving rotation of said transparent developing device is larger than a product of an amount of the color developer accommodated and circulated in said color developing device, a driving torque for driving said color developing device and an angular speed of driving rotation of said color developing device.

7. An image forming apparatus according to claim 1, wherein a proportion of a weight of the transparent toner to a weight of the transparent developer accommodated and circulated in said transparent developing device is larger than a proportion of a weight of the color toner to a weight of the color developer accommodated and circulated in said color developing device.

8. An image forming apparatus according to claim 2, wherein a permeability of the layer thickness regulating member of said transparent developing device is higher than a permeability of the layer thickness regulating member of said color developing device.

9. An image forming apparatus according to claim 2, wherein a carrier attracting force of the layer thickness regulating member of said transparent developing device and the magnetic pole of the fixed magnet provided at the upstream side with respect to the developer carrying member rotational direction is larger than a charge attracting force of the layer thickness regulating member of said transparent developing device and the magnetic pole of the fixed magnet provided at the upstream side with respect to the developer carrying member rotational direction.

10. An image forming apparatus according to claim 2, wherein a surface roughness of the developer carrying member of said transparent developing device is rougher than a surface roughness of the developer carrying member of said color developing device.

11. An image forming apparatus according to claim 2, wherein a product of an amount of the transparent developer accommodated and circulated in said transparent developing device, a driving torque for driving said transparent developing device and an angular speed of driving rotation of said transparent developing device is larger than a product of an amount of the color developer accommodated and circulated in said color developing device, a driving torque for driving said color developing device and an angular speed of driving rotation of said color developing device.

12. An image forming apparatus according to claim 2, wherein a proportion of a weight of the transparent toner to a weight of the transparent developer accommodated and circulated in said transparent developing device is larger than a proportion of a weight of the color toner to a weight of the color developer accommodated and circulated in said color developing device.

* * * * *